US011072845B2

(12) United States Patent
Kurisu et al.

(10) Patent No.: US 11,072,845 B2
(45) Date of Patent: Jul. 27, 2021

(54) HOT DIP METAL PLATING BATH ROLL AND METHOD OF PRODUCTION OF HOT DIP METAL PLATING BATH ROLL

(71) Applicants: NIPPON STEEL CORPORATION, Tokyo (JP); NIPPON STEEL HARDFACING CORPORATION, Tokyo (JP)

(72) Inventors: Yasushi Kurisu, Tokyo (JP); Hayato Konnai, Tokyo (JP); Futoshi Nishimura, Tokyo (JP); Satoshi Uchida, Tokyo (JP); Atsushi Migita, Tokyo (JP); Yuuki Mishima, Tokyo (JP)

(73) Assignees: NIPPON STEEL CORPORATION, Tokyo (JP); NIPPON STEEL HARDFACING CORPORATION, Tokyo (JP)

( * ) Notice: Subject to any disclaimer, the term of this patent is extended or adjusted under 35 U.S.C. 154(b) by 0 days.

(21) Appl. No.: 16/770,003

(22) PCT Filed: Dec. 3, 2018

(86) PCT No.: PCT/JP2018/044351

§ 371 (c)(1),
(2) Date: Jun. 4, 2020

(87) PCT Pub. No.: WO2019/111843

PCT Pub. Date: Jun. 13, 2019

(65) Prior Publication Data

US 2021/0054491 A1 Feb. 25, 2021

(30) Foreign Application Priority Data

Dec. 5, 2017 (JP) ..... JP2017-233440

(51) Int. Cl.

| | |
|---|---|
| ***C23C 2/06*** | (2006.01) |
| ***C23C 2/40*** | (2006.01) |
| ***C23C 2/00*** | (2006.01) |
| ***B05D 1/18*** | (2006.01) |
| ***B05C 3/02*** | (2006.01) |
| ***B05C 3/12*** | (2006.01) |

(52) U.S. Cl.

CPC ..... *C23C 2/06* (2013.01); *B05C 3/02* (2013.01); *B05C 3/125* (2013.01); *B05D 1/18* (2013.01); *C23C 2/00* (2013.01); *C23C 2/40* (2013.01)

(58) Field of Classification Search

None

See application file for complete search history.

(56) References Cited

U.S. PATENT DOCUMENTS

| | | | | |
|---|---|---|---|---|
| 4,361,085 | A * | 11/1982 | Schutz | B31F 1/07 100/211 |
| 2016/0348971 | A1* | 12/2016 | Kurisu | C21D 9/56 |
| 2019/0337031 | A1* | 11/2019 | Jeon | C23C 2/26 |

FOREIGN PATENT DOCUMENTS

| | | | |
|---|---|---|---|
| CN | 104294198 | A | 1/2015 |
| JP | 5-339689 | A | 12/1993 |

(Continued)

OTHER PUBLICATIONS

Notice of Reasons for Refusal dated Jun. 4, 2019 in corresponding Japanese Patent Application No. 2019-513455, with English translation.

*Primary Examiner* — Jethro M. Pence

(74) *Attorney, Agent, or Firm* — Birch, Stewart, Kolasch & Birch, LLP

(57) ABSTRACT

A hot dip metal plating bath roll preventing flaws in a steel sheet due to a bath roll, realizing stable running at a high speed, and improving the productivity of a plated steel sheet, which hot dip metal plating bath roll having vertical grooves each formed on an outer circumferential surface of the roll and including two first curved parts projecting to the outside (Continued)

of the roll and at least one second curved part arranged between the two first curved part and projecting to the inside of the roll and horizontal grooves each formed on an outer circumferential surface of the roll along a barrel length direction of the roll, a pitch $P_1$ (mm) and depth $d_1$ (mm) of the vertical grooves satisfying $1.0 \leq P_1 \leq 10$, $0.2 \leq d_1 \leq 5$, and $d_1 \leq P_1/2$, a depth $d_2$ (mm) being 60% to 150% of the depth $d_1$ of the vertical grooves, and a width $w_2$ (mm) of the horizontal grooves being 2 times or more of the depth $d_2$ or 2 times or more of a radius of curvature (mm) of curved surfaces forming bottom parts of the horizontal grooves and 0.7 times or less of a pitch $P_2$ (mm), the pitch $P_2$ (mm) of the horizontal grooves being $1.0 \leq P_2 \leq 10$.

10 Claims, 12 Drawing Sheets

(56) References Cited

FOREIGN PATENT DOCUMENTS

| | | | |
|---|---|---|---|
| JP | 8-074017 | A | 3/1996 |
| JP | 2000-248345 | A | 9/2000 |
| JP | 2004-091831 | A1 | 3/2004 |
| JP | 2009-161847 | A | 7/2009 |
| JP | 2009-270157 | A | 11/2009 |

* cited by examiner

HOT DIP METAL PLATING BATH ROLL AND METHOD OF PRODUCTION OF HOT DIP METAL PLATING BATH ROLL

FIELD

The present invention relates to a hot dip metal plating bath roll provided in a plating bath of a hot dip metal plating apparatus and to a method of production of a hot dip metal plating bath roll.

BACKGROUND

A hot dip metal plating apparatus is an apparatus for plating a metal strip (for example a steel strip) by zinc or another molten metal. This hot dip metal plating apparatus is provided with, as a roll arranged in a plating bath filled with molten metal, a bath roll (also called a "pot roll" or a "sink roll") for converting a running direction of a steel strip. A steel strip introduced into the plating bath downward at a slant is converted in running direction by the bath roll to upward in the vertical direction, then is run through a pair of support rolls provided in the plating bath and pulled up to outside of the plating bath. After that, gas ejected from wiping nozzles is used to wipe off the excess molten metal deposited on the surfaces of the steel strip and adjust the metal to a predetermined basis weight. The above bath roll is not driven by a drive device but is configured to rotate along with running of the steel strip.

In such a hot dip metal plating apparatus, if making the running speed of the steel strip increase to improve the productivity, the increase in the rotational speed of the bath roll causes the liquid layer formed by the molten metal flowing into the space between the steel strip and the bath roll to increase in thickness. This being so, there is the problem of slip easily occurring between the steel strip and the bath roll. If such slip occurs, slip flaws can be caused on the surface of the steel strip.

Further, in such a hot dip metal plating apparatus, there is granular matter called "dross" formed due to reaction of the Fe eluted from the steel strip and the Al or Zn in the bath. For example, by adjusting the concentration of Al in a plating bath, it is possible to control the ratio of presence of the dross to a certain extent, but in practice the dross is unavoidably present in a plating bath.

If the above dross enters between the steel strip running through the plating bath and the bath roll, the dross can deposit on the bath roll. If the dross deposits on the bath roll, flaws will end up being caused when the dross contacts the surface of the steel strip (press flaws), so the surface conditions of the steel strip will end up falling. Further, if the dross enters between the steel strip and the bath roll, the rotating ability of the bath roll will be inhibited and slip between the steel strip and the bath roll will be caused. Such dross more easily enters between the steel strip and bath roll by increasing the running speed of the steel strip. Therefore, to prevent the occurrence of slip flaws due to slip and press flaws due to deposition of dross, it has been proposed to form grooves on the surface of the bath roll.

For example, PTL 1 discloses art relating to a bath roll having grooves continuously formed in a circumferential direction so as to satisfy predetermined conditions of pitch, depth, and shape. Further, PTL 2 discloses art relating to a bath roll in which grooves are formed continuously in a barrel length direction so that an area of open parts satisfies a predetermined ratio with respect to a total area of the roll surface. By forming grooves continuing in the circumferential direction in the surface of the bath roll (vertical grooves) or grooves continuing in the barrel length direction (horizontal grooves and extended grooves) in this way, it becomes possible to quickly discharge molten metal containing dross which had entered between the steel strip and bath roll. Further, this publication discloses a bath roll further having vertical grooves (spiral grooves) in addition to horizontal grooves so as to increase the efficiency of discharge of molten metal containing dross.

CITATIONS LIST

Patent Literature

[PTL 1] Japanese Unexamined Patent Publication No. 2009-161847

[PTL 2] Japanese Unexamined Patent Publication No. 2009-270157

SUMMARY

Technical Problem

However, the bath roll disclosed in PTL 1 is provided with only vertical grooves formed continuously in the circumferential direction. This being so, when making the steel strip run at a further higher speed, molten metal containing a large amount of dross enters between the steel strip and bath roll and dross deposits and builds up in the grooves. In this case, the molten metal becomes harder to be discharged, the rotating ability of the bath roll deteriorates, and slip easily occurs between the steel sheet and bath roll. This being so, there is the problem that slip flaws and transfer of groove shapes corresponding to the vertical grooves of the bath roll to the surface of the steel sheet occur. Further, by just vertical grooves being formed, molten metal containing dross taken into the vertical grooves once and then discharged can be again caught in the vertical grooves by flow along the roll rotational direction. As a result, the vertical grooves are clogged by buildup of dross and the molten metal can no longer be suitably discharged, so there is the problem that slip etc. occur more readily.

Further, the regions of formation of the horizontal grooves and vertical grooves formed at the bath roll disclosed in PTL 2 are defined by only the ratio of area of open parts of the grooves with respect to the surface area of side circumferential parts of the bath roll. That is, the shapes, widths, and depths of these grooves are not prescribed in any way in this publication. However, the dross deposited on and entering into the surface of the bath roll is 3D granular matter. Therefore, if the dross enters these grooves, depending on the shapes, widths, and depths of these grooves, there is the problem that the dross will build up at the groove bottoms and will not be discharged or the dross will end up filling the grooves conversely making the rotating ability of the bath roll worse or ending up causing press flaws at the steel sheet.

Further, in recent years, in hot dip metal plating apparatuses, the trend has been for increasing the running speed of the steel strip for improving the productivity. As explained above, if the running speed increases, slip easily occurs, but prevention of slip between the steel strip and bath roll is sought even at the currently demanded greater running speeds.

Therefore, the present invention was made in consideration of the above problem. An object of the present invention is to provide a novel and improved hot dip metal plating bath roll and a method of production of the same able to prevent flaws in steel sheets due to the bath roll and realize stable running at a higher speed and to improve the productivity of plated steel sheets.

Solution to Problem

The gist of the present invention for solving the above technical issue is as follows:

(1) A hot dip metal plating bath roll, which hot dip metal plating bath roll having vertical grooves each formed on an outer circumferential surface of the roll along a circumferential direction of the roll and including two first curved parts projecting to the outside of the roll and at least one second curved part arranged between the two first curved parts and projecting to the inside of the roll and horizontal grooves each formed on an outer circumferential surface of the roll along a barrel length direction of the roll, a pitch $P_1$ (mm) and depth $d_1$ (mm) of the vertical grooves satisfying the following formulas (101) to (103):

$$1.0 \leq P_1 \leq 10 \quad (101)$$

$$0.2 \leq d_1 \leq 5 \quad (102)$$

$$d_1 P_1/2 \quad (103),$$

a depth $d_2$ (mm) of the horizontal grooves being 60% to 150% of the depth $d_1$ of the vertical grooves, and a width $w_2$ (mm) of the horizontal grooves being 2 times or more of the depth $d_2$ or 2 times or more of a radius of curvature (mm) of curved surfaces forming bottom parts of the horizontal grooves and 0.7 times or less of a pitch $P_2$ (mm) of the horizontal grooves, the pitch $P_2$ (mm) of the horizontal grooves being $1.0 \leq P_2 \leq 10$.

(2) The hot dip metal plating bath roll according to (1), which is used in contact with the steel strip in a molten metal plating bath, wherein an area of regions at an outer circumferential surface of the roll able to contact the steel strip is 1.0% to 20% of the area of the circumferential surface of the roll provided with the grooves.

(3) The hot dip metal plating bath roll according to (1) or (2), wherein the depth $d_2$ of the horizontal grooves is 80% to 120% of the depth $d_1$ of the vertical grooves.

(4) The hot dip metal plating bath roll according to any one of (1) to (3), wherein a cross-sectional shape of the horizontal grooves is a V-shape.

(5) The hot dip metal plating bath roll according to any one of (1) to (3), wherein each horizontal groove includes two third curved parts projecting toward the outside of the roll and at least one fourth curved part arranged between the two third curved parts and projecting toward the inside of the roll.

(6) The hot dip metal plating bath roll according to any one of (1) to (5), wherein at the outer circumferential surface of the roll, an angle formed by a surface formed between the horizontal grooves and side parts of the horizontal grooves is 65° or less.

(7) The hot dip metal plating bath roll according to any one of (1) to (6), wherein the vertical grooves are comprised of a spiral groove formed in a spiral shape along a circumferential direction of the roll.

(8) The hot dip metal plating bath roll according to any one of (1) to (7), wherein the vertical grooves are comprised of ring-shaped grooves formed in straight line shapes along a circumferential direction of the roll.

(9) A method of production of a hot dip metal plating bath roll, the method of production of a hot dip metal plating bath roll comprising:

a vertical groove forming step of forming, along the circumferential direction of the roll, vertical grooves each including two first curved parts projecting to the outside of the roll and at least one second curved part arranged between the two first curved parts and projecting to the inside of the roll by lathing on an outer circumferential surface of the roll and a horizontal groove forming step of forming, on the outer circumferential surface of the roll, horizontal grooves along a barrel length direction of the roll, a pitch $P_1$ (mm) and depth $d_1$ (mm) of the vertical grooves satisfying the following formulas (101) to (103):

$$1.0 \leq P_1 \leq 10 \quad (101)$$

$$0.2 \leq d_1 \leq 5 \quad (102)$$

$$d_1 P_1/2 \quad (103),$$

a depth $d_2$ (mm) of the horizontal grooves being 60% to 150% of the depth $d_1$ of the vertical grooves, and a width $w_2$ (mm) of the horizontal grooves being 2 times or more of the depth $d_2$ or 2 times or more of a radius of curvature (mm) of curved surfaces forming bottom parts of the horizontal grooves and 0.7 times or less of a pitch $P_2$ (mm) of the horizontal grooves, the pitch $P_2$ (mm) of the horizontal grooves being $1.0 \leq P_2 \leq 10$.

Advantageous Effects of Invention

As explained above, according to the present invention, flaws in a steel sheet caused due to a bath roll are prevented and stable running at a high speed becomes possible, so the productivity of plated steel sheets can be improved.

BRIEF DESCRIPTION OF DRAWINGS

FIG. 7 is a cross-sectional view showing a cross-sectional shape of a vertical groove which a bath roll according to a first modification is provided with.

FIG. 8 is a cross-sectional view showing a cross-sectional shape of a vertical groove which a bath roll according to a second modification is provided with.

FIG. 9 is a cross-sectional view showing a cross-sectional shape of a vertical groove which a bath roll according to a third modification is provided with.

DESCRIPTION OF EMBODIMENTS

Below, referring to the attached drawings, preferred embodiments of the present invention will be explained in detail. Note that, in the Description and drawings, component elements having substantially the same functions and configurations are assigned the same notations and overlapping explanations are omitted. Note that, in the figures, for facilitating the explanation, members not requiring explanations are suitably omitted. Further, the dimensions of the illustrated members are suitably enlarged or reduced for facilitating the explanation and do not show the sizes of the actual members.

Configuration of Hot Dip Metal Plating Apparatus

Figure 1:
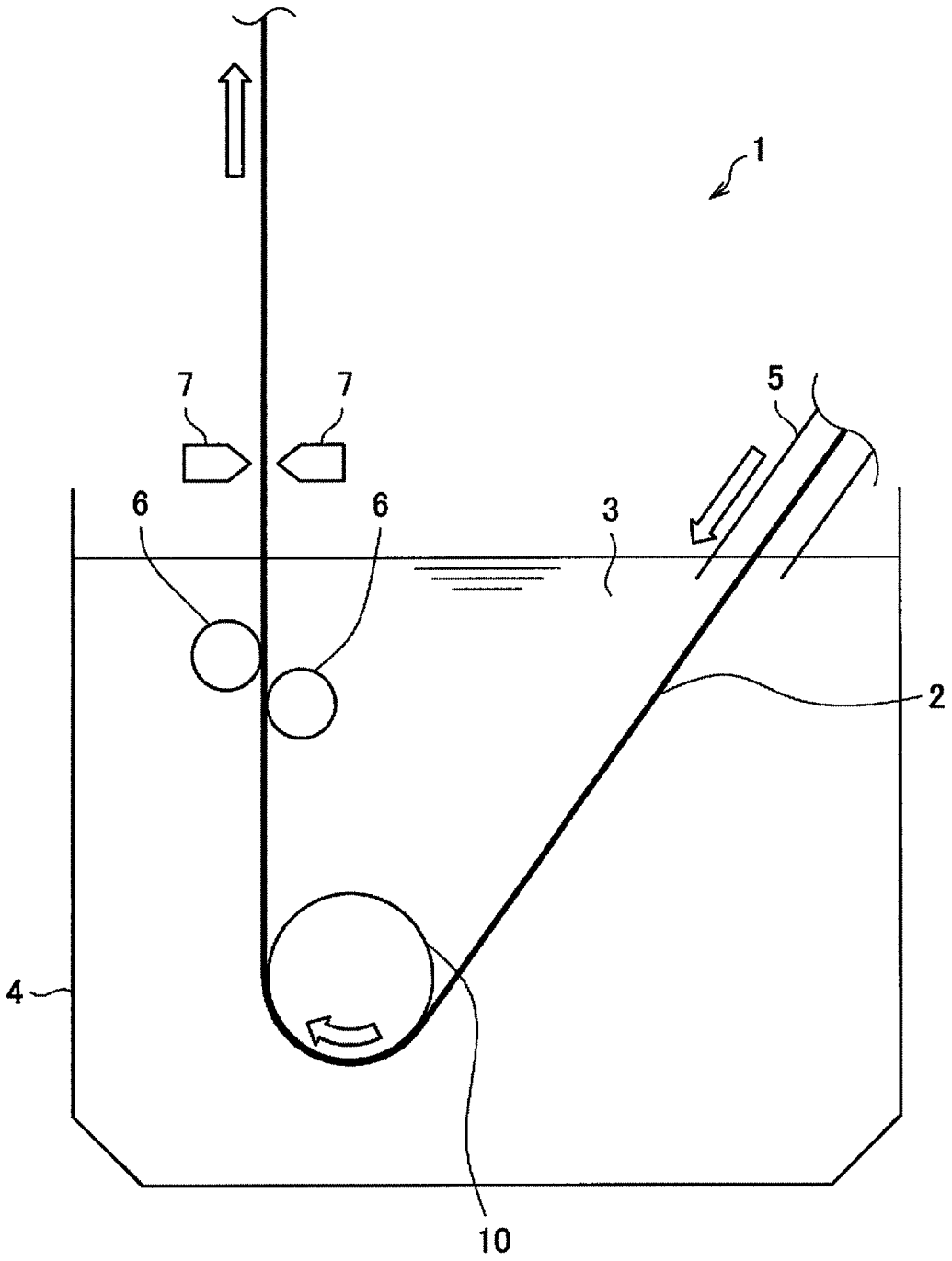
FIG. 1 is a view showing a schematic configuration of a hot dip metal plating apparatus according to one embodiment of the present invention.

FIG. 1 is a view showing the schematic configuration of a hot dip metal plating apparatus 1 according to one embodiment of the present invention. As shown in FIG. 1, the hot dip metal plating apparatus 1 is an apparatus dipping a steel strip 2 in a plating bath 3 filled with molten metal so as to continuously deposit molten metal on the surfaces of the steel strip 2. The hot dip metal plating apparatus 1 is provided with a plating tank 4, a snout 5, a pair of top and bottom support rolls 6, 6, a pair of left and right gas wiping devices 7, 7, and a bath roll 10.

The steel strip 2 is one example of a metal sheet to be plated by molten metal. Note that, in the present embodiment, the example of a steel strip 2 will be used for the explanation, but the material of the metal strip is not particularly limited so long as a strip shaped metal material to be plated.

Further, the type of the molten metal forming the plating bath 3 is not particularly restricted so long as a molten state at a sufficiently lower temperature than the melting point of Fe. In practice, at the type of the molten metal, Zn, Al, Sn, and Pb alone or alloys of the same may be illustrated. Further, as the molten metal, the above metals or alloys, for example, include ones containing Si or P or other nonmetal elements, Ca, Mg, Sr, or other typical metal elements, or Ti, V, Cr, Mn, Fe, Co, Ni, or Cu or other transition metal elements. Below, the example will be explained using molten zinc as the molten metal forming the plating bath 3 and depositing molten zinc on the surface of the steel strip 2 to produce a galvanized steel strip.

The plating tank 4 stores the plating bath 3 comprised of the molten metal. The snout 5 is arranged at a slant so that one end is immersed inside the plating bath 3.

The bath roll 10 is arranged at the lowest part inside of the plating bath 3. The diameter of the roll is larger than the support roll 6. The bath roll 10 is not driven. It rotates along the illustrated arrow mark due to contact with the steel strip 2 and shear. The bath roll 10 according to the present embodiment changes the direction of the steel strip 2 introduced through the snout 5 to the inside of the plating bath 3 downward at a slant to vertically upward. The specific configuration of the bath roll 10 will be explained in the explanation of the embodiments.

The support rolls 6 are arranged inside the plating tank 4 downstream of the bath roll 10 in the running direction of the steel strip 2 and are arranged so as to sandwich the steel strip 2 fed out from the bath roll 10 from the two left and right sides. The support rolls 6 are supported by not shown bearings (for example, plain bearings, roller bearings, etc.) to be able to rotate. Note that, just a single support roll or three or more may also be set. Further, the support rolls need not be provided.

The gas wiping devices 7 are arranged above the plating tank 4 and have the function of blowing a gas (for example, nitrogen or air) to the surfaces on the two sides of the steel strip 2 to wipe off the molten metal deposited on the surfaces of the steel strip 2 to control the amount of deposition of the molten metal.

A steel strip 2 annealed in an annealing furnace at an upstream process is dipped through the snout 5 in the plating tank 4 filled with the plating bath 3, passes the bath roll 10 and support rolls 6 to be pulled up in the vertical direction, and runs to the outside of the plating bath 3. The steel strip 2 run to the outside of the plating bath 3 is adjusted by the gas wiping devices 7 in deposition of molten metal deposited on the surfaces, then passes through a not shown alloying furnace etc. and is sent to a downstream process.

Further, the running speed of the steel strip 2 is not particularly limited, but for example is 100 mpm to 160 mpm. In particular, for improving the productivity, the running speed may also be made 130 mpm to 160 mpm. In the case of such a comparatively high running speed, in general, slip easily occurs between the bath roll and the steel strip, but in the bath roll 10 according to the present embodiment, such a slip is suppressed.

First Embodiment

Configuration of Roll

Figure 2:
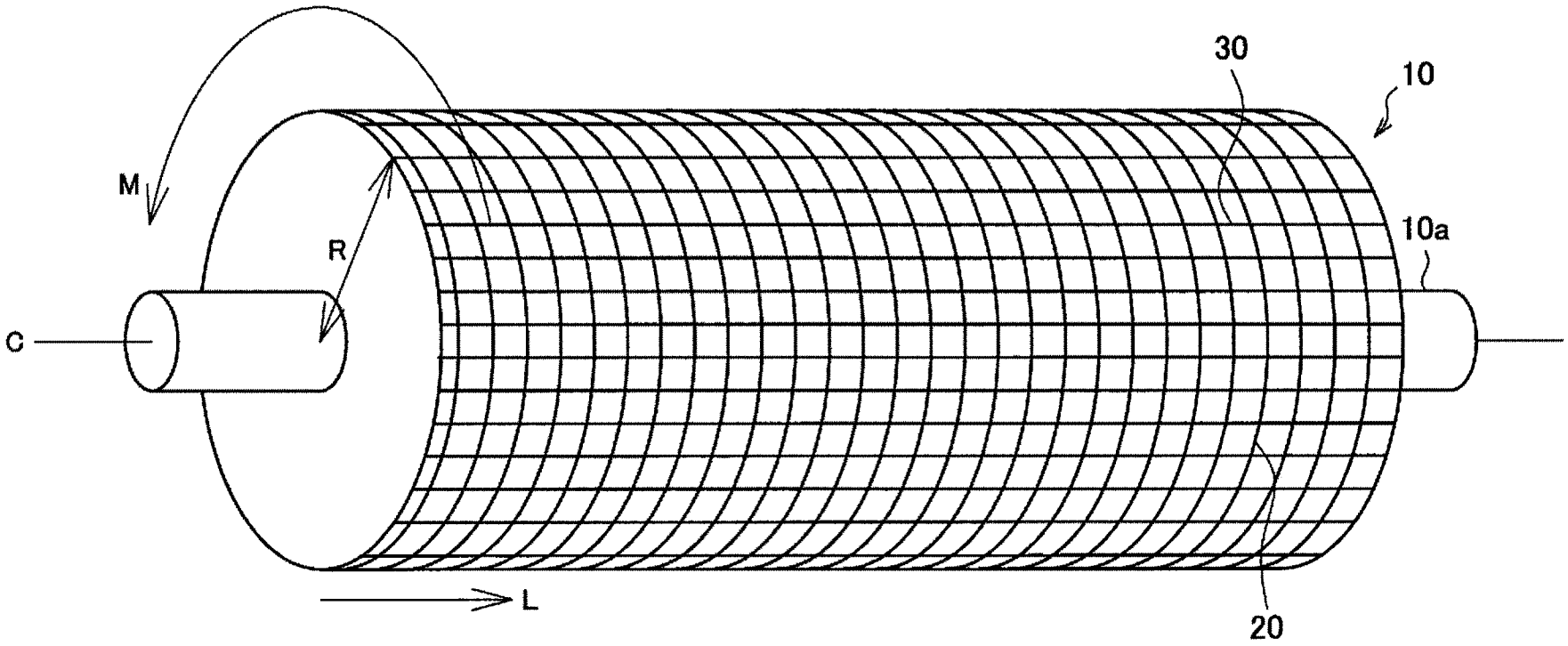
FIG. 2 is a perspective view showing one example of a bath roll according to a first embodiment of the present invention.

Next, the configuration of a bath roll 10 according to a first embodiment of the present invention will be explained. FIG. 2 is a perspective view showing one example of the bath roll according to the first embodiment of the present invention, while FIG. 3 is a side view showing one example of the bath roll 10 according to the first embodiment of the present invention.

The bath roll 10 according to the present embodiment has a roll width larger than the width of the steel strip 2. For example, the roll width of the bath roll 10 is 1400 mm to 2000 mm, while the roll diameter is 600 to 800 mm. This bath roll 10 rotates about a roll shaft 10*a* of the rotational axis of the bath roll 10 and assists the running of the steel strip 2 inside the plating bath 3.

Figure 3:
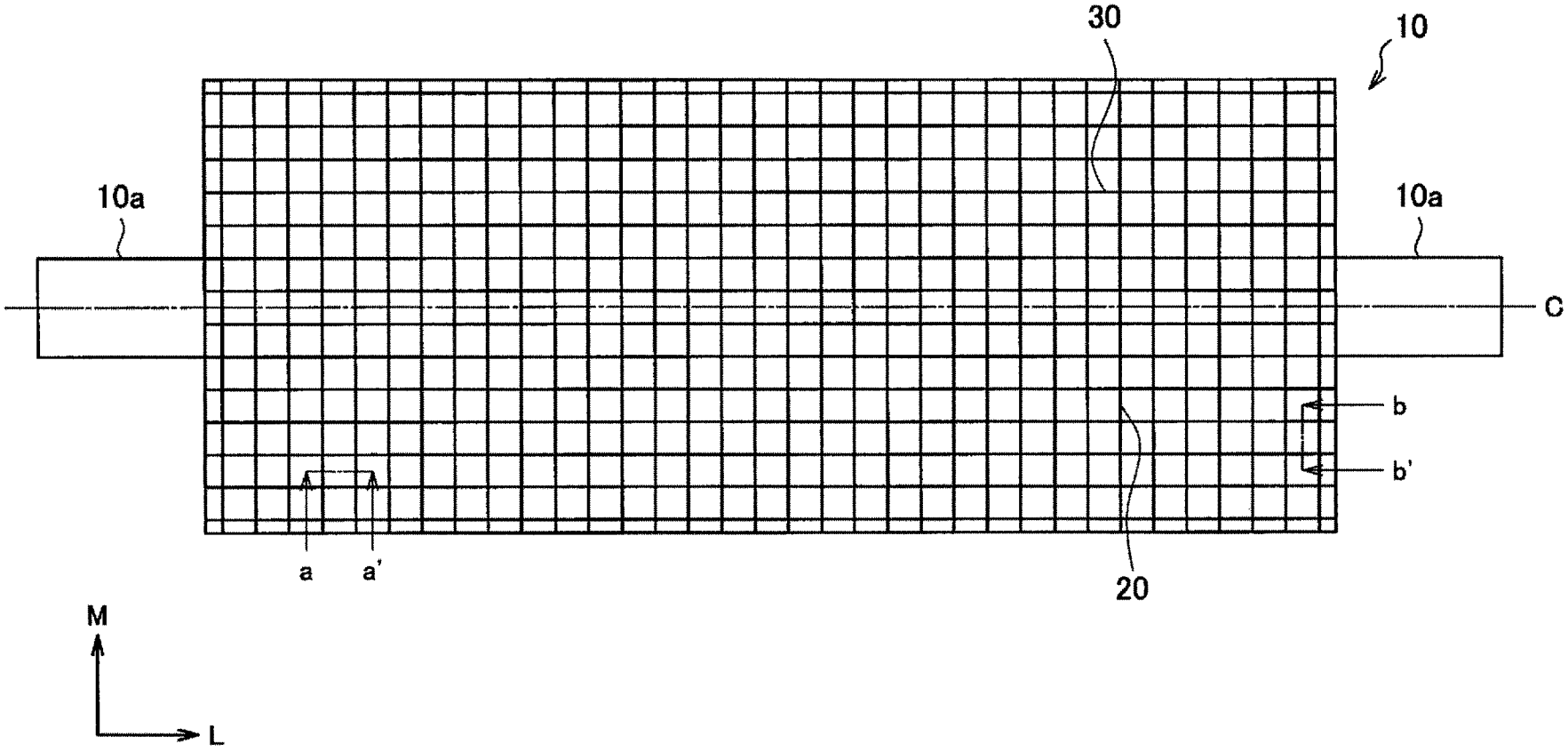
FIG. 3 is a side view showing one example of a bath roll according to the first embodiment of the present invention.

Further, as shown in FIG. 2 and FIG. 3, the surface of the bath roll 10 (outer circumferential surface) is formed with grooves extending continuously along the circumferential direction M of the bath roll 10 (vertical grooves 20) and grooves extending continuously along the barrel length direction L of the bath roll 10 (horizontal grooves 30) over substantially the entire surface other than about 10 mm at the end parts of the bath roll body surface.

Note that, in the Description and drawings, as shown in FIG. 2, for convenience, the barrel length direction of the bath roll 10 will be referred to as the "barrel length direction L", the rotational axis when the bath roll 10 rotates will be referred to as the "center axis C", the direction perpendicularly intersecting the barrel length direction L while circling around the bath roll 10 will be referred to as the "circumferential length direction M", and the radial direction of the bath roll 10 will be referred to as the "radial direction R". The barrel length direction L of the bath roll 10 in the present embodiment is parallel to the center axis C. Further, in the radial direction R, the outer surface side of the bath roll 10 will be referred to as the "outside" while the center axis C side will be referred to as the "inside".

Configuration of Vertical Grooves 20

The vertical grooves 20, as shown in FIG. 3, are ring-shaped grooves formed in straight lines in a plane vertical to the barrel length direction L of the bath roll 10 (along the circumferential direction). Due to the vertical grooves 20 being such ring shaped grooves, discharge (movement) of dross is prevented from concentrating at one part of the bath roll 10 in the barrel length direction L.

The vertical grooves 20 in the first embodiment, as shown in FIG. 3, extend vertical to the barrel length direction L (roll shaft 10*a* direction) in the plan view, that is, along the circumferential direction M.

If the bath roll 10 rotates about the center axis C of the roll shaft 10*a* as the rotational axis, the ring shaped vertical grooves 20 rotate along the circumferential length direction M. For this reason, the dross caught between the bath roll 10 and the steel strip 2 spreads along the circumferential length direction M to the two directions inside the vertical grooves 20, that is, one side and the other side of the M direction (circumferential length direction M). Further, the dross spreading inside the vertical grooves 20 also enters the horizontal grooves 30 connected with the vertical grooves 20 and spreads to both of one side and the other side of the L direction (barrel length direction L). The dross which enters inside the vertical grooves 20 and the horizontal grooves 30 in this way spreads in the surface direction without unevenness in both the L direction (barrel length direction L) and the M direction (circumferential length direction M).

Cross-Sectional Shape of Vertical Grooves 20

Figure 4:
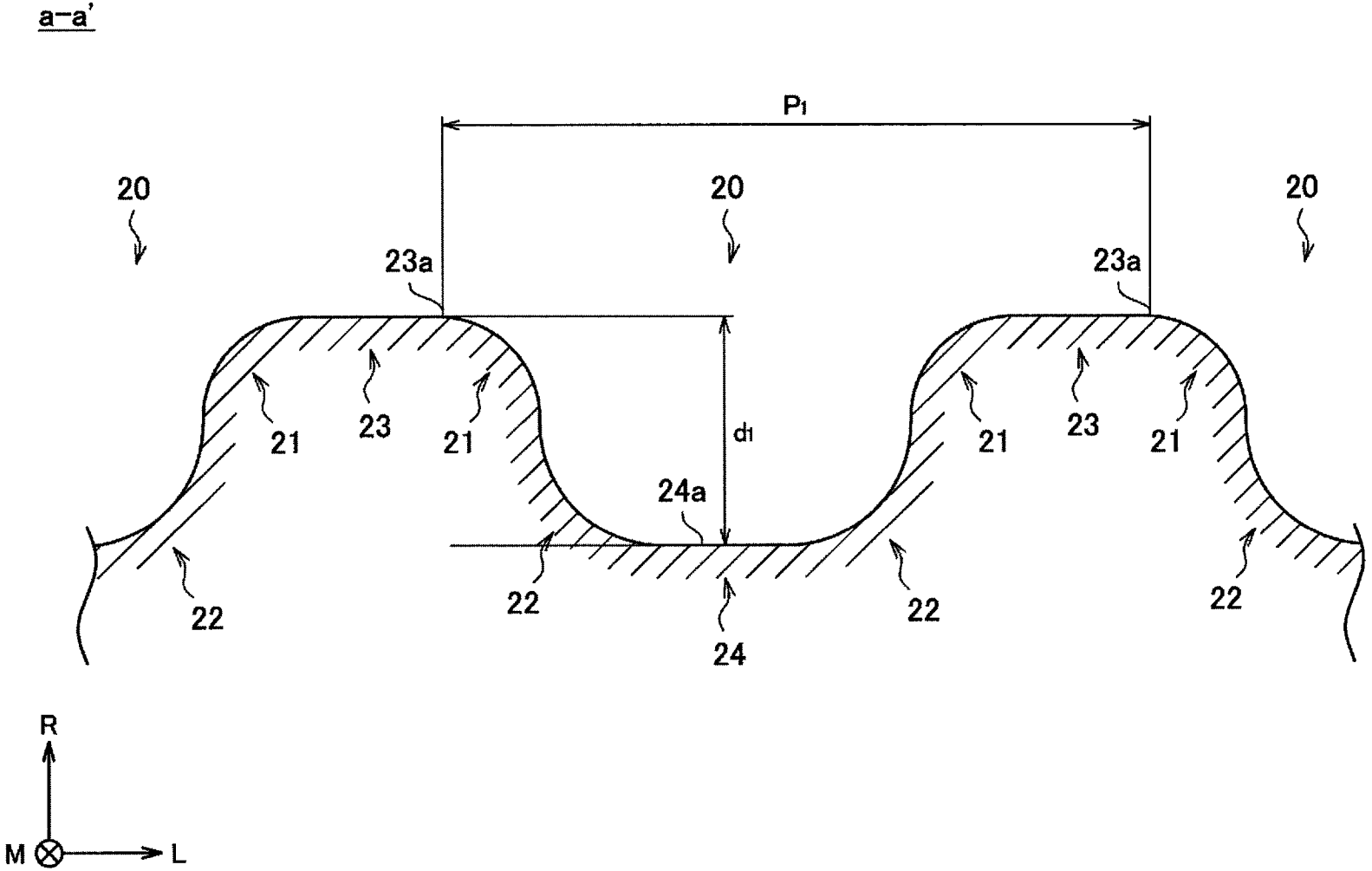
FIG. 4 is a view showing one example of a cross-sectional shape of a vertical groove provided at a surface of a bath roll according to the same embodiment.

Next, the cross-sectional shape of the vertical grooves 20 provided at the surface of the bath roll 10 will be explained. FIG. 4 is a schematic view of the configuration near the surface of the bath roll 10 in a section along the line a-a' of FIG. 3, that is, a section cut along the plane including the center axis C of the bath roll 10. FIG. 4 shows one example of the cross-sectional shape of the vertical grooves 20 of the present embodiment.

The surface of the bath roll 10 is formed with a plurality of vertical grooves 20 at a pitch $P_1$ (mm) and a depth $d_1$ (mm) parallel with each other. Further, as shown in another embodiment explained later, the vertical grooves 20 may be comprised of a spiral groove formed in a spiral shape along the circumferential length direction M of the roll shaft 10*a*.

Note that, in this Description, the "pitch" means the distance of repetition of the grooves formed at the surface of the bath roll 10 in the barrel length direction or the circumferential direction. In the present embodiment, the pitch $P_1$ of the vertical grooves 20, for example, as shown in FIG. 4, shows the distance between adjoining connecting points 23*a* in the barrel length direction L. Note that, the "connecting points 23*a*" in the present embodiment mean the boundaries between the first curved parts 21 and the first flat parts 23.

Further, in this Description, the "depth" means the distance between top parts comprised of parts corresponding to outermost parts of the bath roll 10 in a projecting part of a surface of the bath roll 10 (locations in each projecting part the furthest from the center axis C of the bath roll 10 in the radial direction R) and a bottom part comprised of a part corresponding to an innermost part of the bath roll 10 in a recessed part of a surface of the bath roll 10 (location in each recessed part the closest to the center axis C of the bath roll 10 in the radial direction R). Specifically, the depth $d_1$ of the vertical grooves 20 shown in FIG. 4 means the distance in the radial direction R between the top parts (for example, the connecting points 23*a*) and the bottom part 24*a* of the second flat part 24.

In this Description, the "width" means the distance between side walls in a same groove in the case where there are surfaces (side walls) vertical to a surface of a bath roll 10 connecting projecting parts of the surface of the bath roll 10 and a recessed part of the surface of the bath roll 10. On the other hand, in a case where there are no such side walls, it means the distance between top parts comprised of parts corresponding to outermost parts of the bath roll 10 in projecting parts of a surface of the bath roll 10 (locations in section cutting bath roll 10 at cross-section vertical to center axis C of bath roll 10 the furthest from the center axis C of the bath roll 10 in the radial direction R) (for example, the connecting points 23*a* in FIG. 4).

Here, a "projecting part" in the Description means a part of the surface of the bath roll 10 in which no groove is formed provided running along the barrel length direction or the circumferential direction and which sticks out toward the outside of the bath roll 10. This projecting part includes part of the top part forming the surface the furthest from the center axis C of the bath roll 10 in the radial direction R.

Further, a "recessed part" in the Description means a part in a groove formed in a surface of the bath roll 10 recessed toward the inside of the bath roll 10. This recessed part includes part of the bottom part forming the surface the closest to the center axis of the bath roll 10 in the radial direction. That is, the surface of the bath roll 10 according to the present embodiment is formed with recesses and projections continuing along the barrel length direction and the circumferential direction. The vertical grooves 20 and the horizontal grooves 30 provided on the surface of the bath roll 10 according to the present embodiment can mainly be obtained by formation of the recessed parts. However, as explained in detail below, these grooves can include all or part of the projecting parts.

As shown in FIG. 4, the cross-sectional shape of a vertical groove 20 is comprised of a combination of curves and straight lines on a cross-section cut along a plane including the center axis C of the bath roll 10. Specifically, a vertical groove 20 is comprised of two first curved parts 21 projecting toward the outside from the center axis C of the bath roll 10 (outside from the center axis C in the radial direction R in FIG. 4), two second curved parts 22 arranged between the two first curved parts 21 continuing from the first curved parts 21 and projecting toward the center axis C side of the bath roll 10 (the center axis C side from the outside in the radial direction R at FIG. 4, that is, the inside), and a second flat part 24 arranged between the two second curved parts 22. Further, two consecutive vertical grooves 20 (that is, the end parts at the outsides of the first curved parts 21) form first flat parts 23.

The first curved parts 21 and the first flat parts 23 positioned at the two ends of a vertical groove 20 (two ends of projecting parts of the vertical groove 20 of FIG. 4 in the barrel length direction L) form parts of the projecting parts continuing in the circumferential length direction M. Further, in this case, the first flat parts 23 become the top parts of the projecting parts. Further, the two second curved parts 22 and the second flat part 24 form a recessed part continuing in the circumferential length direction M.

Note that, in the example shown in FIG. 4, the cross-sectional shapes of the first flat parts 23 and the second flat part 24 are formed as straight line shapes, but the present invention is not limited to such an example. For example, the first flat parts 23 may be formed as curved shapes projecting toward the outside of the bath roll 10 and the second flat part 24 may be formed as a curved shape projecting toward the center axis C side of the bath roll 10.

The steel strip 2 shown in FIG. 1 mainly contacts the first flat parts 23 shown in FIG. 4 at the time of contact with the bath roll 10. In this case, due to the cross-sectional shapes of the boundary parts of the first flat parts 23 and the vertical grooves 20 being formed by curved surfaces like the first curved parts 21, it is possible to keep the contact surface pressure of the steel strip 2 and bath roll 10 at the boundary parts from increasing. Due to this, it is possible to keep flaws from forming at the surface of the steel strip 2 due to the increase in the contact surface pressure and to keep the patterns of the contact regions 120 shown in FIG. 6 explained later formed by the vertical grooves 20 and the horizontal grooves 30, that is, the groove shapes, from being transferred.

Further, by the cross-sectional shape of parts of the bottom parts of vertical grooves 20 being formed by curved surfaces like the second curved parts 22, the dross clogging the vertical grooves 20 receives pressure, whereby it easily moves through the insides of the vertical grooves 20. For this reason, it is possible to prevent the deposition of dross at the bottoms of the vertical grooves 20 etc. and facilitate discharge of that dross. Due to this, it is possible to keep dross entering the vertical grooves 20 from clogging them.

Furthermore, the inventors defined the pitch $P_1$ and depth $d_1$ of the vertical grooves 20 in addition to defining the cross-sectional shape of the vertical grooves 20. Specifically, the pitch $P_1$ (mm) and depth $d_1$ (mm) of the vertical grooves 20 according to the present embodiment are provided to satisfy the following (1) to (3):

$$1.0 \leq P_1 \leq 10 \quad (1)$$

$$0.2 \leq d_1 \leq 5 \quad (2)$$

$$d_1 \leq P_1/2 \quad (3)$$

The pitch $P_1$ of the vertical grooves 20 is preferably 1.0 mm or more from the viewpoint of the workability and is preferably 10 mm or less from the viewpoint of suitable contact surface pressure between the steel strip 2 and the bath roll 10. Further, the depth $d_1$ is preferably made 0.2 mm to 5 mm from the viewpoint of the workability and cost. If the pitch $P_1$ of the vertical grooves 20 is smaller than 1.0 mm, work making the depth $d_1$ of the vertical grooves 20 0.2 mm or more is de facto difficult. Further, if the pitch $P_1$ of the vertical grooves 20 is larger than 10 mm, the contact area of the steel strip 2 and the bath roll 10 decreases, so the contact surface pressure of the steel strip 2 and the bath roll 10 increases and the groove shape is more easily transferred to the steel strip 2. The pitch $P_1$ of the vertical grooves 20 is preferably 1.3 mm to 2.0 mm.

If the depth $d_1$ of the vertical grooves 20 is smaller than 0.2 mm, the steel strip more easily slips due to the fluid lubrication action due to the molten zinc. Further, if the depth $d_1$ of the vertical grooves 20 is greater than 5 mm, the amount of the surface of the bath roll 10 ground down becomes greater and the cost rises. Further, if forming a thermal spray coating for suppressing melt loss due to molten zinc over the entire surface of the bath roll 10, it becomes difficult to form the thermal spray coating uniformly on the surfaces of the vertical grooves 20. The depth $d_1$ of the vertical grooves 20 is preferably 0.3 mm to 1.0 mm.

The depth $d_1$ of the vertical grooves 20 is made a depth of $P_1/2$ or less. By the depth $d_1$ being $P_1/2$ or less, when thermally spraying the bath roll 10, the thermal spray particles can cover the entire surfaces of the vertical grooves 20. On the other hand, if the depth $d_1$ of the vertical grooves 20 is larger than $P_1/2$, it becomes difficult to thermally spray the thermal spray particles at the regions of the vertical grooves at the C side, so it becomes difficult to uniformly form a thermal spray coating on the surface of the bath roll 10. Note that, to uniformly form the thermal spray coating, the depth $d_1$ of the vertical grooves 20 is more preferably made smaller than $P_1/3$.

Further, by the pitch $P_1$ and depth $d_1$ of the vertical grooves 20 satisfying the above relationships of formulas (1) to (3), at the time of high speed running of the steel strip 2, the bath roll 10 can store excess molten zinc in the vertical grooves 20 and discharge it through the later explained horizontal grooves 30 from between the steel strip 2 and bath roll 10. At this time, the dross is also stored in the vertical grooves 20 and discharged through the horizontal grooves 30 together with the excess molten zinc.

Further, by the pitch $P_1$ and depth $d_1$ being in the above ranges, the dross present between the bath roll 10 and the steel strip 2 can be sufficiently stored in the vertical grooves 20 and the stored dross can be removed through the horizontal grooves 30.

Note that, the first curved parts 21 according to the present embodiment are arc shapes having a first radius of curvature, while the second curved parts 22 are arc shapes having a second radius of curvature. In this case, the magnitudes of the first radius of curvature and the second radius of curvature are not particularly limited. They can be suitably set considering the contact surface pressure of the steel strip 2 and the bath roll 10, the ease of removal of the dross, etc. Specifically, the first radius of curvature and the second radius of curvature are preferably larger than 0.1 mm. Further, the first flat parts 23 and the second flat parts 24 are suitably formed in accordance with the selected pitch $P_1$, depth $d_1$, width $W_1$, first radius of curvature, and second radius of curvature. Note that, the first curved parts 21 and the second curved parts 22 need not necessarily be arc shaped.

Above, the cross-sectional shape of the vertical grooves 20 was explained, but the present invention is not limited to this example. Specifically, as shown in the later explained modifications, the vertical grooves 20 can take any cross-sectional shapes so long as including two first curved parts and at least one second curved part between the first curved parts 21.

Configuration of Horizontal Grooves 30

Figure 5:
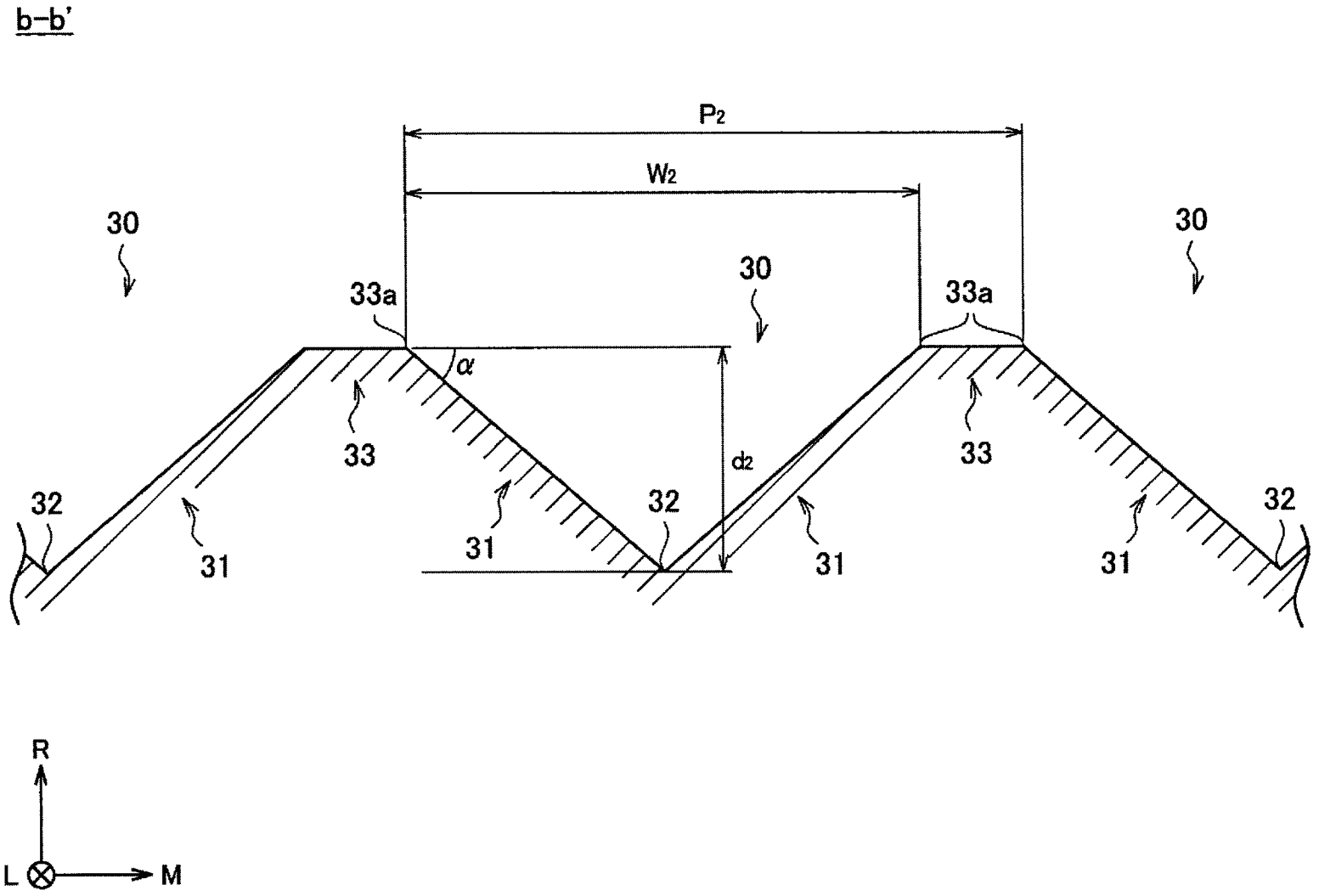
FIG. 5 is a view showing one example of a cross-sectional shape of a horizontal groove provided at a surface of a bath roll according to the same embodiment.

The horizontal grooves 30 in the first embodiment, as shown in FIG. 3, are formed along the barrel length direction L of the roll shaft 10*a* of the bath roll 10 in the surface of the bath roll 10 in parallel with each other. The horizontal grooves 30 are grooves extending in straight line shapes in a plan view. Further, as the horizontal grooves 30, as shown in FIG. 5, a plurality of horizontal grooves can be formed at a pitch $P_2$ (mm) with a depth $d_2$ (mm) and width $w_2$ (mm) in parallel with each other. As shown in another embodiment explained later, the horizontal grooves 30 may be formed in the surface of the bath roll 10 inclined from the barrel length direction (axial direction of bath roll 10) L by a predetermined angle in range.

Cross-Sectional Shape of Horizontal Grooves

Next, the cross-sectional shape of the horizontal grooves 30 provided at the surface of the bath roll 10 will be explained. FIG. 5 is a schematic view of the configuration of the vicinity of the surface of the bath roll 10 in a section cut along the line b-b' of FIG. 3, that is, a section cut by a cross-section vertical to the center axis C of the bath roll 10.

In FIG. 4, one example of the cross-sectional shape of the horizontal grooves 30 provided at the surface of the bath roll 10 according to the present embodiment is shown.

As shown in FIG. 5, the cross-sectional shape of a horizontal groove 30 is a V-shape. Specifically, the cross-sectional shape of the horizontal groove 30 is comprised of two side parts 31 and a bottom part 32 at which the two side parts 31 intersect. Further, two consecutive horizontal grooves 30 (that is, the end parts at the outsides of the side parts 31) are connected by first flat parts 33.

Note that, the pitch $P_2$ of the horizontal grooves 30 according to the present embodiment, as shown in FIG. 5, means the adjoining distance between connecting points 33*a* of the side parts 31 and the first flat parts 33 in the circumferential length direction M. Further, the depth $d_2$ of the horizontal grooves 30 according to the present embodiment means the distance between the top parts (for example, connecting points 33*a*) and a bottom part 32 in the radial direction R. The width $w_2$ of the horizontal grooves 30 according to the present embodiment means the distance between two top parts forming a horizontal groove 30, specifically, two connecting points 33*a*.

As shown in FIG. 5, by forming the horizontal grooves 30 along the barrel length direction L of the bath roll 10, molten metal including dross flowing into the vertical grooves 20 can be discharged through the horizontal grooves 30 to outside the surface of the roll.

Furthermore, the inventors discovered that dross is effectively discharged by making the depth $d_2$ of the horizontal grooves 30 according to the present embodiment a depth of 60% to 150% of the depth $d_1$ of the vertical grooves 20. If the depth $d_2$ becomes less than 60% of the depth $d_1$, the dross does not flow well into the horizontal grooves 30 and the effect of discharge of dross is not exhibited. Further, if the depth $d_2$ becomes more than 150% of the depth $d_1$, the dross flowing into the horizontal grooves 30 ends up building up and the effect of discharge of dross is not exhibited. Further, as explained above, it becomes difficult to form a thermal spray coating on the horizontal grooves 30 for suppressing melt loss due to the molten zinc.

Further, the fact that by making the depth $d_2$ of the horizontal grooves 30 a depth of 80% to 120% of the depth $d_1$ of the vertical grooves 20, the dross can be more effectively discharged from the horizontal grooves 30 was discovered by the inventors. The fact that by doing this, even if further raising the running speed of the steel strip 2, there is greater resistance to slip between the steel strip 2 and the bath roll 10 and slip flaws and transfer of the groove shapes can be suppressed was found by the inventors. Therefore, it becomes possible to stabilize more the high speed running of the steel strip 2.

Furthermore, in the present embodiment, the width $w_2$ of the horizontal grooves 30 is 2 times or more of the depth $d_2$ and 0.7 time or less of the pitch $P_2$ (mm) of the horizontal grooves 30. Due to this, the dross or excess molten zinc transported from the vertical grooves 20 can be sufficiently received by the horizontal grooves 30 and the area of the contact portions 50 explained later can be made the preferred area and occurrence of slip and formation of flaws at the steel strip 2 can be prevented. As opposed to this, if the width $w_2$ of the horizontal grooves 30 is 2 times or less of the depth $d_2$, dross flowing into the horizontal grooves 30 becomes harder to flow and ends up building up. The effect of discharge of dross is not exhibited. Further, if the width $w_2$ of the horizontal grooves 30 is more than 0.7 time the pitch $P_2$ (mm) of the horizontal grooves 30, the contact area of the steel strip 2 and the bath roll 10 decreases, so the contact surface pressure of the steel strip 2 and the bath roll 10 increases and patterns corresponding to the contact regions 120 shown in FIG. 6 explained later formed by the vertical grooves 20 and the horizontal grooves 30, that is, the groove shapes, become easily transferred to the steel strip 2.

The width $w_2$ of the horizontal grooves 30 is preferably 0.7 time or less of the pitch $P_2$ (mm), more preferably 0.5 time or less of the pitch $P_2$ (mm), from the viewpoint of making the contact area between the bath roll 10 and the steel strip 2 a suitable range.

Further, the pitch $P_2$ (mm) of the horizontal grooves 30 is, for example, 1.0 mm to 10 mm. Due to this, the effect of discharge of dross can be exhibited. Furthermore, preferably the pitch $P_2$ (mm) of the horizontal grooves 30 is 60% to 150% of the pitch $P_1$ of the vertical grooves 20.

Furthermore, the angle $\alpha$ formed by a surface formed between horizontal grooves 30 (top part) and a side part 31 of a horizontal groove 30 is preferably 65° or less, more preferably 30° to 50°. Due to this, it is possible to apply a thermal spray coating in a uniform thickness when forming a thermal spray coating on the surface of the bath roll 10 by thermal spraying.

Surface Shape of Roll

Figure 6:
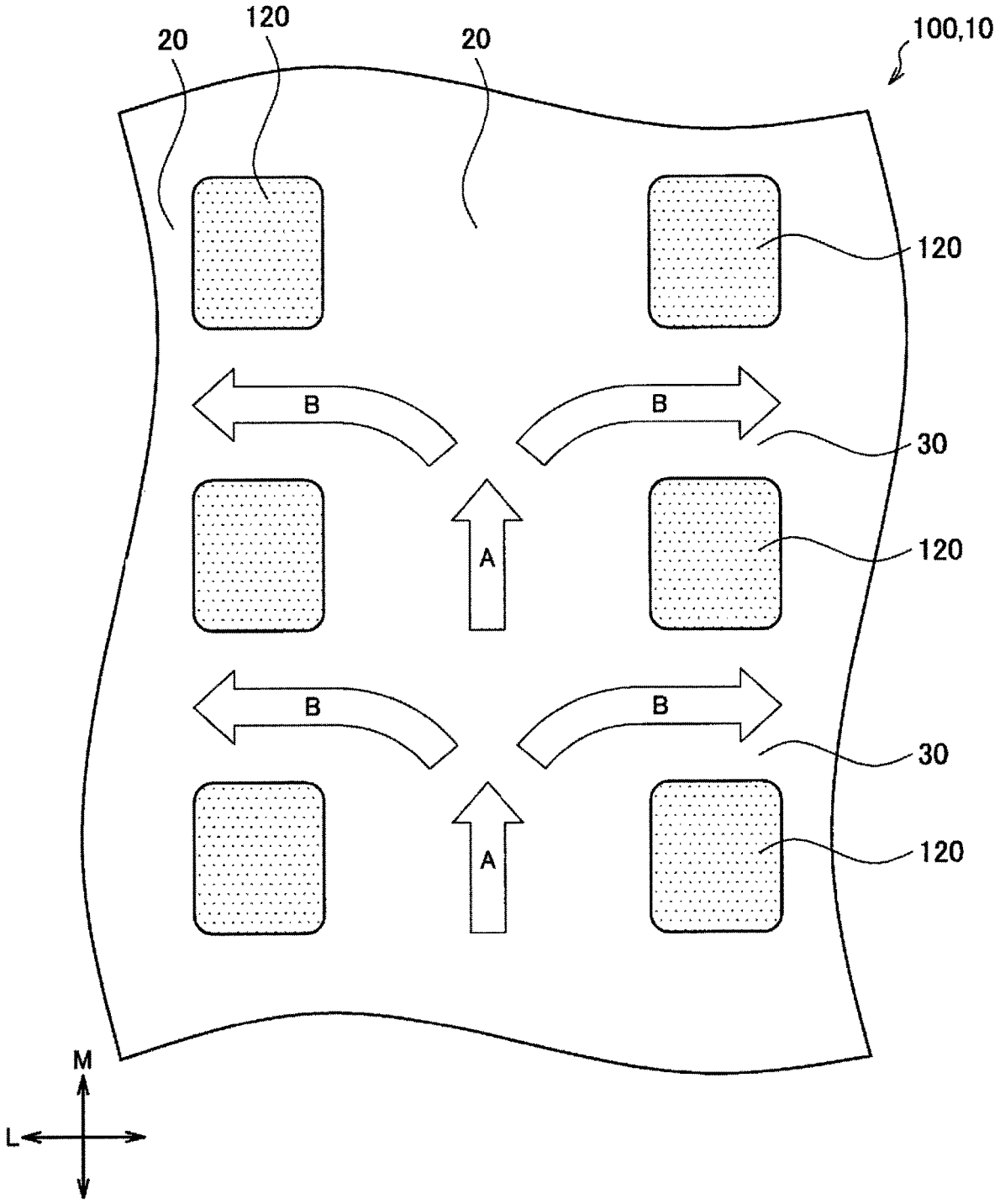
FIG. 6 is a plan view spreading open part of a circumferential surface of a bath roll according to the same embodiment.

Next, referring to FIG. 6, the shape of the surface of the bath roll 10 according to the present embodiment will be explained. FIG. 6 is a plan view spreading open part of the circumferential surface of the bath roll 10 according to the present embodiment. As shown in FIG. 6, the circumferential surface 100 of the bath roll 10 has groove regions 110 comprised of the vertical grooves 20 and the horizontal grooves 30 and contact regions 120 comprised of top parts surrounded by the vertical grooves 20 and the horizontal grooves 30 and parts of the vertical grooves 20 and the horizontal grooves 30.

The contact regions 120 are regions which can contact the steel strip 2 when the bath roll 10 is set in the plating bath 3. The contact regions 120 contact the steel strip 2 while the steel strip 2 is run through the plating bath 3.

Therefore, the area of the contact regions 120 is suitably set from the viewpoint of prevention of slip and formation of flaws. The area of the contact regions 120 is preferably for example 1.0% to 20% of the area of the circumferential surface 100 of the bath roll 10 provided with the grooves. If the area of the contact regions 120 is 1.0% or more, the pressure applied to the steel strip 2 by the contact regions 120 is prevented from becoming too large and flaws are prevented from being formed at the steel strip 2. Further, if the area of the contact regions 120 is 20% or less, slip of the steel strip 2 due to the drop in pressure applied to the steel strip 2 can be prevented.

Preferably, the area of the contact regions 120 is 5% to 10% of the area of the circumferential surface 100 of the bath roll 10 provided with the grooves. Due to this, it is possible to sufficiently obtain the above effect while sufficiently enlarging the groove regions 110, so it is possible to improve the efficiency of discharge of dross much more.

Note that, as explained above, the contact regions 120 include not only the top parts surrounded by the vertical grooves 20 and the horizontal grooves 30, but also parts of the vertical grooves 20 and the horizontal grooves 30 near the top parts. This is due to the fact that when running the steel strip 2, a certain pressure is caused between the steel strip 2 and the bath roll 10. In the present embodiment, in addition to the top parts, regions up to depths of 5% of the depth $d_2$ from the top parts at the horizontal grooves 30 are included in the contact regions 120. Furthermore, at the vertical grooves 20 as well, regions up to depths of 5% of the depth $d_2$ from the top parts are similarly included in the contact regions 120. Note that, the steel strip 2 runs so as to intersect the direction of extension of the horizontal grooves 30, so parts of the horizontal grooves 30 easily contact the steel strip 2, so 5% of the depth $d_2$ of the horizontal groove 30 is made the standard when setting the contact regions.

The groove regions 110 hold the excess molten zinc and dross present between the steel strip 2 and the bath roll 10 and transport the same to discharge them to the outside of the bath roll 10. Due to this, slip and occurrence of flaws due to dross are prevented. Specifically, the excess molten zinc containing dross first enters the vertical grooves 20 of the groove regions 110 and is pushed out in the circumferential direction together with rotation of the bath roll 10 (arrows A), then, as shown by the arrows B in the figure, is transported from the vertical grooves 20 to the horizontal grooves 30. Furthermore, in the horizontal grooves 30, excess molten zinc containing dross is discharged along the barrel length direction L of the bath roll 10.

In the present embodiment, by the pitch $P_1$ and depth $d_1$ of the vertical grooves 20 being in the above-mentioned ranges and the depth $d_2$ and the width $w_2$ of the horizontal grooves 30 being in the above-mentioned ranges, the excess molten zinc containing dross is discharged without being obstructed due to the volume of the dross.

Method of Production of Roll

Next, the method of production of the bath roll 10 according to the present embodiment will be explained.

As the base material of the bath roll 10, a ferrous metal roll having a low thermal expansion coefficient and excellent in resistance to corrosion by molten metal is used. For example, a martensite-based stainless steel centrifugal cast material can be used as the base material of the bath roll 10.

The cross-sectional shape of the vertical grooves 20 according to the present embodiment includes the first curved parts 21 and the second curved parts 22. In particular, the first curved parts 21 are parts contacting the steel strip 2, so for control of the contact surface pressure, precision is sought at the surface. Therefore, to maintain the precision of the curved shapes, the vertical grooves 20 are formed by cutting by lathing. For forming such vertical grooves 20, for example, tool steel or carbide bits having shapes corresponding to the cross-sectional shape of the vertical grooves 20 can be used.

If the cross-sectional shape of the horizontal grooves 30 according to the present embodiment is a V-shape, for forming the horizontal grooves 30, knurling can be used. In this case, even with lathes not having feed mechanisms in the axial direction, the horizontal grooves 30 can be easily formed. Further, when the cross-sectional shape of the horizontal grooves 30 according to the present embodiment is curved, cutting can be used for forming the horizontal grooves 30.

Note that, the order of forming the above-mentioned vertical grooves 20 and horizontal grooves 30 is not particularly limited. However, when using knurling for forming the horizontal grooves 30, first the vertical grooves 20 are formed, then the horizontal grooves 30 are formed.

Further, after forming the vertical grooves 20 and the horizontal grooves 30, the surface of the bath roll 10 including these grooves is formed with a thermal spray coating. The coating, for example, may also be a known ceramic coating or cermet coating. Further, the thermal spraying may be performed by high velocity gas spraying, plasma spraying, detonation spraying, and other known thermal spraying techniques. Further, as a further sealing treatment coating, an oxide layer coating comprised of chrome oxide, silica, zirconia, alumina, etc. may be formed on the thermal spray coating.

Above, the bath roll 10, the vertical grooves 20 and the horizontal grooves 30 formed on the bath roll 10, and the method of production of a bath roll 10 according to the present embodiment were explained.

First Modification

Next, modifications of the cross-sectional shape of the vertical grooves 20 of the bath roll 10 according to the present embodiment will be explained. Note that, in the vertical grooves 20A to C according to the following modifications, the pitches $P_1$ and depths $d_1$ are explained as all satisfying the above formulas (1) to (3). Further, in the modifications, the configurations of the horizontal grooves and the preferable configurations of the surface shapes can be made similar ones to the above-mentioned bath roll 10, so explanations will be omitted.

Figure 7:
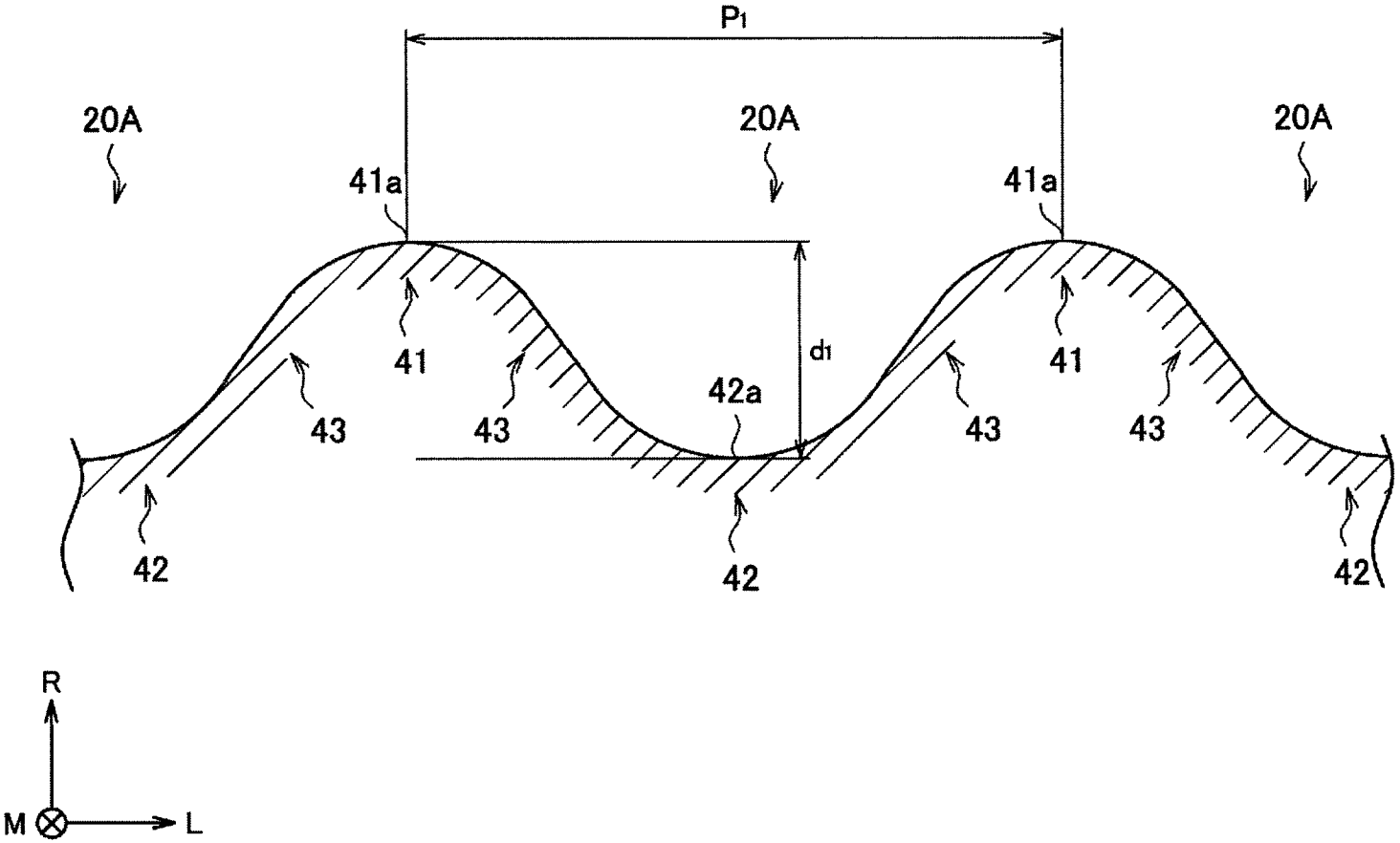

FIG. 7 is a cross-sectional view showing the cross-sectional shape of the vertical grooves 20A which the bath roll according to the first modification is provided with.

As shown in FIG. 7, the cross-sectional shape of a vertical groove 20A which the bath roll according to the present modification is provided with is comprised of a combination of curves on a cross-section cut along a plane including the center axis C of the bath roll 10. Specifically, the vertical groove 20A is comprised of a second curved part 42 projecting toward the inside of the bath roll 10 (center axis C side from outside in the radial direction R), two side parts 43 extending from the two ends of the second curved part 42, and two first curved parts 41 extending from ends of the side parts 43 at opposite sides from the second curved part 42 sides and projecting toward the outside of the bath roll 10 (outside from the center axis C at the radial direction R). Further, at the top parts 41*a*, the first curved parts 41 are connected with the first curved parts of other adjoining vertical grooves 20.

The first curved parts 41 positioned at the two ends of the vertical groove 20A form parts of the projecting part. Further, the second curved part 42 forms the recessed part.

Note that, in the example shown in FIG. 7, the side parts 43 are formed in straight line shapes, but the present invention is not limited to such an example. For example, the side parts 43 may also be formed in curved shapes.

Further, the pitch $P_1$ of the vertical grooves 20A according to the present modification, as shown in FIG. 7, means the distance between two consecutive top parts 41*a* in the barrel length direction L. Further, the depth $d_1$ of the vertical grooves 20A means the distance in the radial direction R between the top parts 41*a* (locations in a section cutting through the bath roll 10 in a cross-section vertical to the center axis C of the bath roll 10 furthest from the center axis C of the bath roll 10 in the radial direction R) and a bottom part 42*a* of the second curved part 42 (location closest to the center axis C of the bath roll 10 in the radial direction R).

Due to this configuration, first, the steel strip 2 contacts the bath roll 10 at the top parts 41*a*. Due to this, the change in the distribution of the contact surface pressure at a portion in the width direction of the steel strip 2 contacting the steel strip 2 becomes gentler, so transfer of groove shapes can be made more difficult. That is, the hot dip metal plating can be made uniform.

Further, by making the shape of the bottom parts of the vertical grooves 20A arc shapes, it is possible to keep dross from depositing on and building up at the bottom parts. Due to this, it is possible to keep dross from clogging the vertical grooves 20A.

Second Modification

Figure 8:
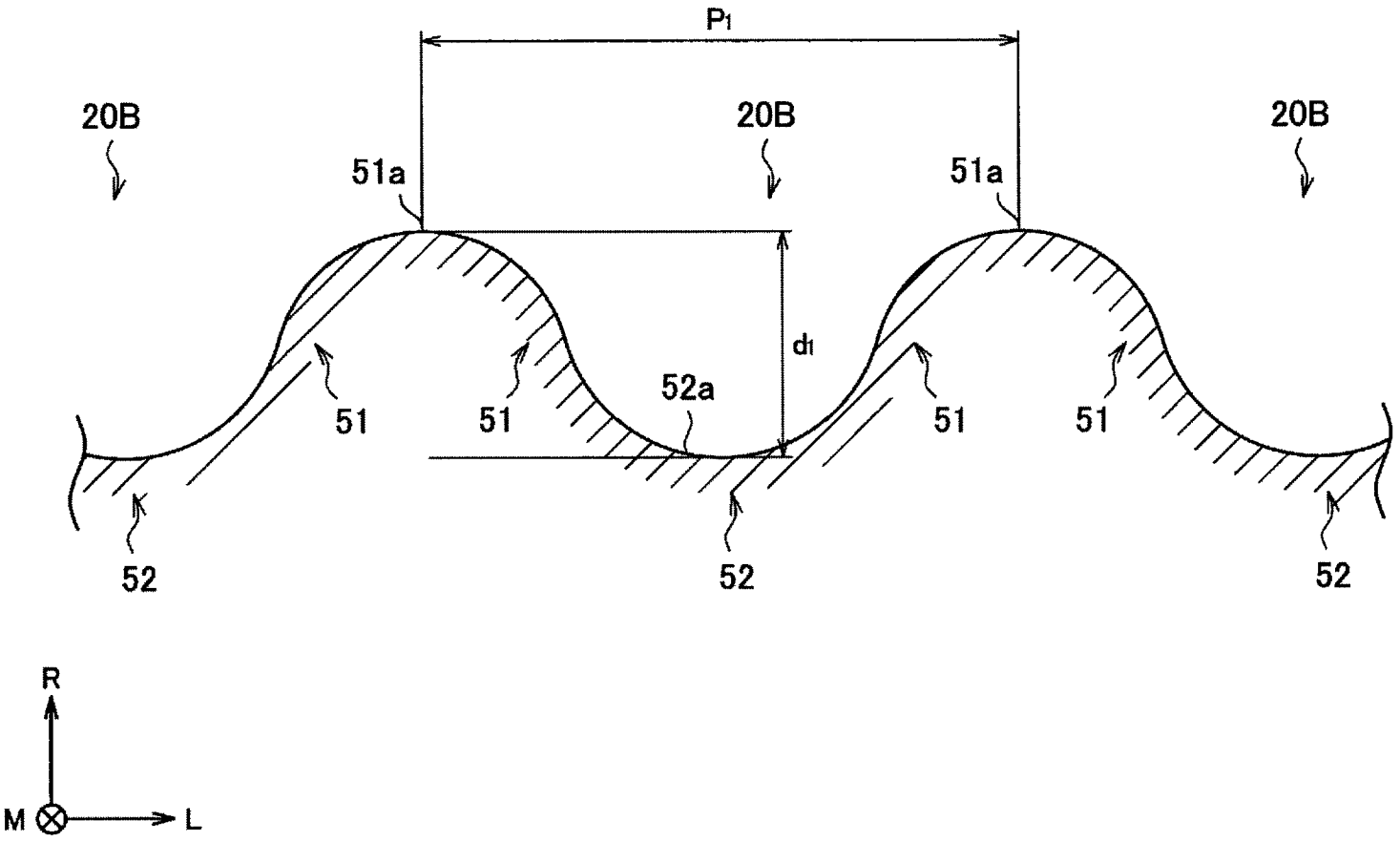

FIG. 8 is a cross-sectional view showing the cross-sectional shape of the vertical grooves 20B which the bath roll according to the second modification is provided with.

As shown in FIG. 8, the cross-sectional shape of a vertical groove 20B which the bath roll according to the present modification is provided with is comprised of a combination of curves on a cross-section cut along a plane including the center axis C of the bath roll 10. Specifically, the vertical groove 20B is comprised of a second curved part 52 projecting toward the inside of the bath roll 10 (center axis C side from outside in the radial direction R) and two first curved parts 51 extending from the two ends of the second curved part 52 and projecting toward the outside of the bath roll 10 (outside from the center axis C at the radial direction R). Further, at the top parts 51*a*, the first curved parts 51 are connected with the first curved parts of other adjoining vertical grooves 20B.

The first curved parts 51 positioned at the two ends of the vertical groove 20B form parts of the projecting part. Further, the second curved part 52 forms the recessed part.

Further, the pitch $P_1$ of the vertical grooves 20B according to the present modification, as shown in FIG. 8, means the distance between two consecutive top parts 51*a* in the barrel length direction L. Further, the depth $d_1$ of the vertical grooves 20B means the distance in the radial direction R between the top parts 51*a* and a bottom part 52*a* of the second curved part 52.

Due to this configuration, in the same way as the above-mentioned first modification, the change in the distribution of the contact surface pressure at a portion in the width direction of the steel strip 2 contacting the steel strip 2 becomes gentler, so transfer of groove shapes can be made more difficult. That is, the hot dip metal plating can be made uniform. Further, by making the shape of the bottom part of the vertical grooves 20B arc shapes, it is possible to keep dross from depositing on and building up at the bottom parts. Due to this, it is possible to keep dross from clogging the vertical grooves 20B.

Third Modification

Figure 9:
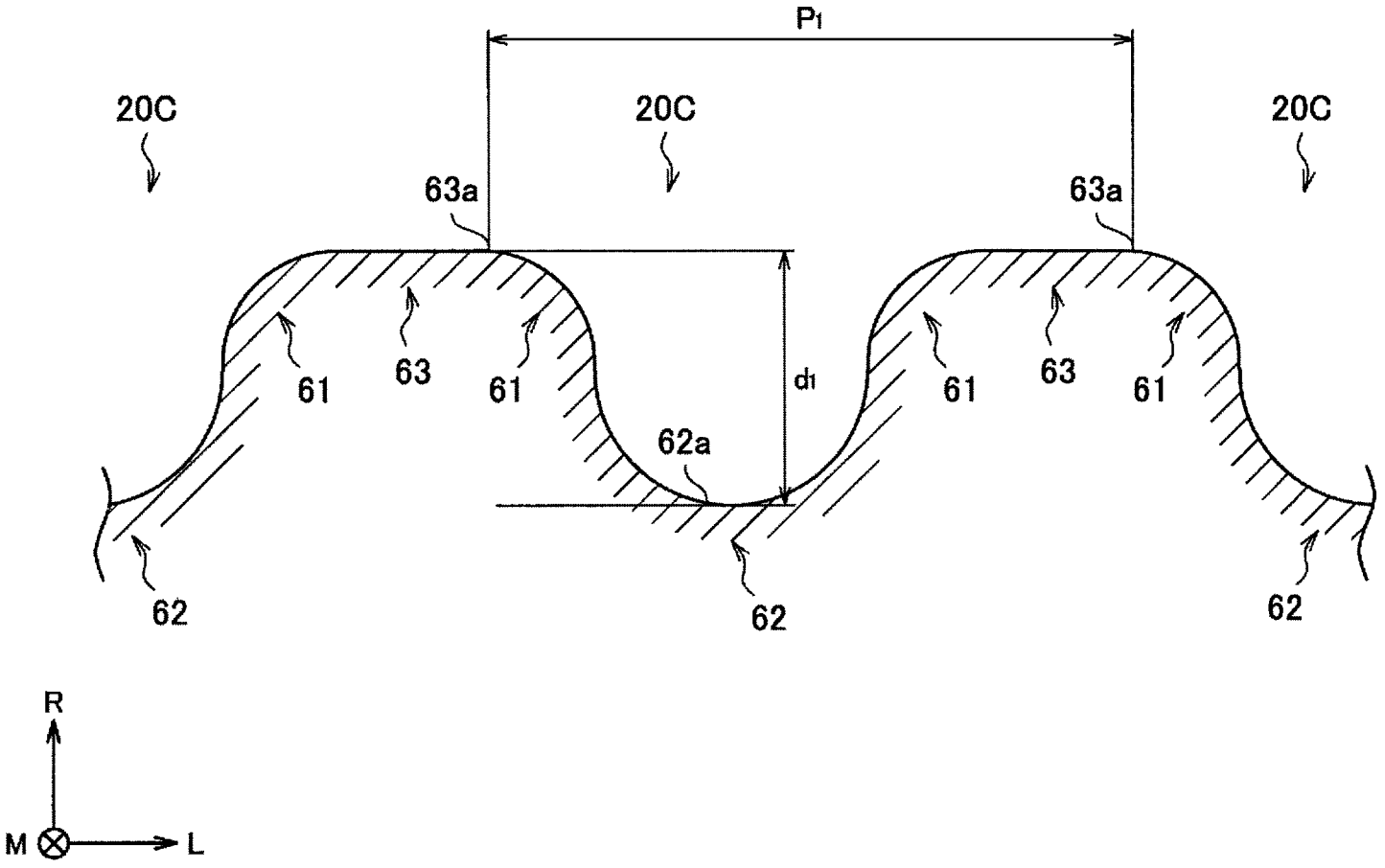

FIG. 9 is a cross-sectional view showing the cross-sectional shape of the vertical grooves 20C which the bath roll according to the third modification is provided with.

As shown in FIG. 9, the cross-sectional shape of a vertical groove 20C which the bath roll according to the present modification is provided with is comprised of a combination of curves on a cross-section cut along a plane including the center axis C of the bath roll 10. Specifically, the vertical groove 20C is comprised of a second curved part 62 projecting toward the inside of the bath roll 10 (center axis C side from outside in the radial direction R) and two first curved parts 61 extending from the two ends of the second curved part 62 and projecting toward the outside of the bath roll 10 (outside from the center axis C at the radial direction R). Further, two consecutive vertical grooves 20C (that is, the ends of the outsides of the first curved parts 61) are connected by the first flat part 63. Further, at the top parts 61*a* (locations in section cutting bath roll 10 at cross-section vertical to center axis C of bath roll 10 the furthest from the center axis C of the bath roll 10 in the radial direction R), the first curved parts 61 are connected with the first curved parts of other adjoining vertical grooves 20B.

The first curved parts 61 positioned at the two ends of the vertical groove 20C and the first flat part 63 form parts of the projecting part. Further, the second curved part 62 forms the recessed part.

Note that, in the example shown in FIG. 9, the first flat part 63 is formed in a straight line shape, but the present invention is not limited to such an example. For example, the first flat part 63 may be formed in a curved shape projecting toward the outside of the bath roll 10.

Further, the pitch $P_1$ of the vertical grooves 20C according to the present modification, as shown in FIG. 9, means the adjoining distance between connecting points 63*a* of the first curved parts 61 and first flat parts 63 in the barrel length direction L. Further, the depth $d_1$ of the vertical grooves 20C according to the present modification means the distance in the radial direction R between the top parts (locations in a section cutting through the bath roll 10 in a cross-section vertical to the center axis C of the bath roll 10 furthest from the center axis C of the bath roll 10 in the radial direction R, for example, the connecting point 63*a*) and a bottom part 62*a* of the second curved part 62 (location closest to the center axis C of the bath roll 10 in the radial direction R).

As explained in the above-mentioned embodiment, the steel strip 2 mainly contacts the first flat parts 63 at the time of contact with the bath roll 10. In this case, due to the boundary parts of the first flat parts 63 and the vertical groove 20C being formed by curved surfaces such as the first curved parts 61, the contact surface pressure of the steel strip 2 and bath roll 10 at the boundary parts can be kept from increasing. Due to this, it is possible to keep flaws from forming at the surface of the steel strip 2 due to the increase of the contact surface pressure and keep groove shapes from being transferred.

Further, by making the shape of the bottom parts of the vertical grooves 20C arc shapes, it is possible to keep dross from depositing on and building up at the bottom parts. Due to this, it is possible to keep dross from clogging the vertical grooves 20C.

Above, the configuration of the bath roll 10 according to the present embodiment and modifications were explained. Note that, for the cross-sectional shape of the vertical grooves 20 disclosed in the above embodiment and its modifications, suitable shapes can be employed so long as satisfying the above formulas (1) to (3) and the relationship of the depth of grooves relating to the vertical grooves 20 and the horizontal grooves 30 and having widths of the horizontal grooves 30 such as explained above. For example, these cross-sectional shapes can be suitably employed based on the operating conditions of the hot dip metal plating apparatus 1 (running speed, concentrations of constituents of plating bath, temperature of the plating bath, material of the steel strip or shape of the steel strip, etc.) or the processing conditions relating to the size or material of the bath roll 10 etc.

Second Embodiment

Next, a bath roll 10 according to a second embodiment of the present invention will be explained. In the present embodiment, the cross-sectional shape of the horizontal grooves 30A of the bath roll 10 differs from the cross-sectional shape of the horizontal grooves 30 according to the above first embodiment. Below, the points of difference of the present embodiment from the first embodiment will be explained. Explanations of similar matters will be omitted.

Figure 10:
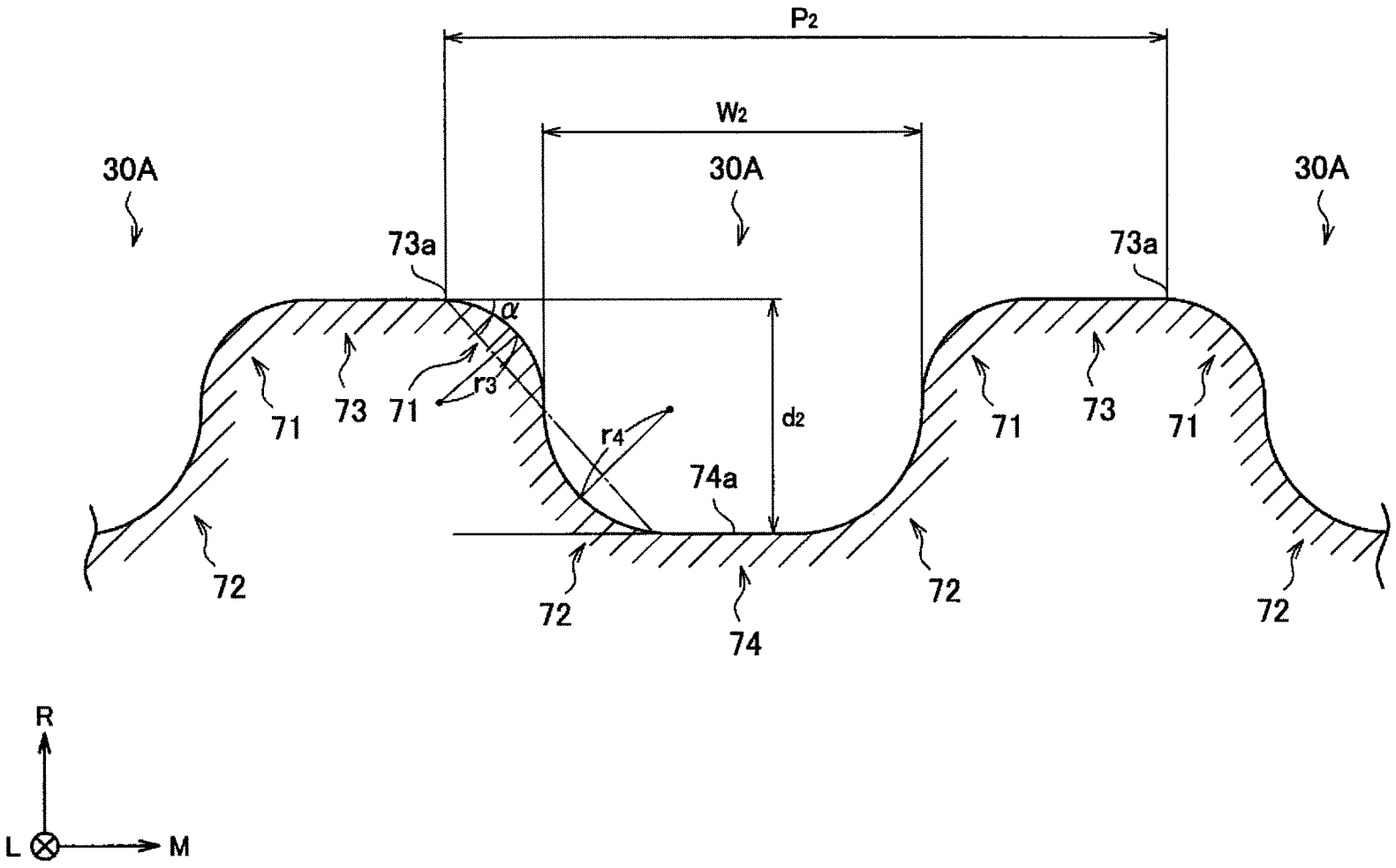
FIG. 10 is a view showing one example of a cross-sectional shape of a horizontal groove formed at a surface of a bath roll according to a second embodiment of the present invention.

FIG. 10 is a view showing one example of the cross-sectional shape of the horizontal grooves 30A formed the surface of the bath roll 10 according to the present embodiment.

As shown in FIG. 10, the cross-sectional shape of the horizontal grooves 30A is comprised of a combination of curves and straight lines on the cross-section cut along the cross-section vertical to the center axis C of the bath roll 10. Specifically, a horizontal groove 30A has a third radius of curvature $r_3$ (mm) and is comprised of two third curved parts 71 projecting toward the outside of the bath roll 10 (outside from the center axis C in the radial direction R), two fourth curved parts 72 arranged between the two third curved parts 71 continuing from the third curved parts 71, having a fourth radius of curvature $r_4$ (mm), and projecting toward the inside of the bath roll 10 (the center axis C side from the outside in the radial direction R), and a fourth flat part 74 arranged between the two fourth curved parts 72. Further, two consecutive horizontal grooves 30A (that is, the end parts at the outsides of the third curved parts 71) are connected by a third flat part 73. This cross-sectional shape is similar to the cross-sectional shape of the vertical grooves 20 of the bath roll 10 according to the first embodiment shown in FIG. 4.

The third curved parts 71 and the third flat parts 73 positioned at the two ends of a horizontal groove 30A form parts of the projecting parts continuing in the barrel length direction L. Further, the two fourth curved parts 72 and a fourth flat part 74 form a recessed part continuing in the barrel length direction L.

Note that, in the example shown in FIG. 10, the third flat parts 73 and fourth flat part 74 are formed in straight line shapes, but the present invention is not limited to such an example. For example, the third flat parts 73 may be formed as curved shapes projecting toward the outside of the bath roll 10 and the fourth flat part 74 may be formed as a curved shape projecting toward the inside of the bath roll 10.

Further, in the present embodiment, the pitch $P_2$ of the horizontal grooves 30A means, for example, as shown in FIG. 10, the adjoining distance between connecting points 73*a* of the third curved parts 71 and the third flat parts 73 in the barrel length direction L. Further, in the present embodiment, the depth $d_2$ of the horizontal grooves 30A means the distance between top parts (for example, connecting points 73*a*) and a bottom part 74*a* of a fourth flat part 74 in the radial direction R.

Furthermore, in the present embodiment, the width $w_2$ of the horizontal grooves 30A means the distance between surfaces vertical to a third flat part 73 formed between a third curved part 71 and fourth flat part 74. Further, in the present embodiment, the angle $\alpha$ formed between the third flat part 73 (top part) formed between horizontal grooves 30A and a side part of the horizontal groove 30A can be made the angle with respect to the top part up to the side surface connecting the third curved part 71 and the fourth curved part 72 (or angle formed by two ends when connecting the third curved part 71 and the fourth curved part 72 and the top part). In this case, the angle $\alpha$ is found as the arc tangent of $d_2/(r_3+r_4)$.

Further, in the present embodiment, the width $w_2$ of the horizontal grooves 30A is 2 times or more of the radius of curvature $r_4$ (mm) of the curved surfaces forming the bottom parts of the horizontal grooves 30A, that is, the fourth curved parts 72, and ½ or less of the pitch $P_2$ (mm) of the horizontal grooves. Due to this, the dross or excess molten zinc transported from the vertical grooves 20 can be sufficiently received by the horizontal grooves 30A and the area of the contact portions 50 explained later can be made the preferred range and occurrence of slip and formation of flaws at the steel strip 2 can be prevented. As opposed to this, if the width $w_2$ of the horizontal grooves 30A is 2 times or less of the radius of curvature $r_4$, dross flowing into the horizontal grooves 30A becomes harder to flow and ends up building up. The effect of discharge of dross is not exhibited. Further, if the width $w_2$ of the horizontal grooves 30A is more than ½ the pitch $P_2$ (mm) of the horizontal grooves 30A, it is not possible to form top parts at the two sides of the horizontal grooves 30A and the area of the contact portions 50 becomes extremely small.

Further, the pitch $P_2$ (mm) of the horizontal grooves 30A is, for example, 1.0 mm to 10 mm. Due to this, the effect of discharge of dross can be exhibited. Furthermore, preferably the pitch $P_2$ (mm) of the horizontal grooves 30A is 60% to 150% of the pitch $P_1$ of the vertical grooves 20.

Furthermore, the angle $\alpha$ formed by a surface formed between horizontal grooves 30A (top part) and a side part of a horizontal groove 30A is preferably 65° or less, more preferably 40° to 50°. Due to this, it is possible to apply a thermal spray coating in a uniform thickness when forming a thermal spray coating on the surface of the bath roll 10 by thermal spraying.

Note that, in the present embodiment, the third curved part 71 is an arc shape having a third radius of curvature $r_3$, while the fourth curved part 72 is an arc shape having a fourth radius of curvature $r_4$. In this case, the magnitudes of the third radius of curvature $r_3$ and fourth radius of curvature $r_4$ are not particularly limited and can be suitably set considering the contact surface pressure between the steel strip 2 and bath roll 10 etc. Specifically, the third radius of curvature $r_3$ and fourth radius of curvature $r_4$ are preferably both larger than 0.1 mm. Further, the third flat part 73 and fourth flat part 74 are suitably formed in accordance with the selected pitch $P_2$, depth $d_2$, third radius of curvature $r_3$, and fourth radius of curvature $r_4$. Note that, the third curved part 71 and fourth curved part 72 need not necessarily be arc shapes.

Due to this cross-sectional shape, as explained in the above first embodiment, it is possible to suppress clogging of dross entering the horizontal grooves 30A and prevent deposition of dross at the bottoms of the horizontal grooves 30A etc. Due to this, the effect of discharge of dross is further improved and it is possible to keep dross flaws and slip from occurring due to the dross entering between the steel strip 2 and the bath roll 10.

Note that, the cross-sectional shape of the horizontal grooves 30A is not limited to the example shown in FIG. 10. For example, the cross-sectional shape of the horizontal grooves 30A may also be a cross-sectional shape comprised of curves (and straight lines) on a cross-section such as shown in the modifications of the vertical grooves 20 according to the first embodiment (FIG. 7 to FIG. 9). Due to such a shape, the effect of discharge of dross can be enhanced.

Third Embodiment

Next, a bath roll 10A according to a third embodiment of the present invention will be explained. In the present embodiment, the vertical grooves 200 of the bath roll 10A differ from the vertical grooves 20 according to the above first embodiment and are formed by a spiral groove of a spiral shape. Below, the points of difference of the present embodiment from the first embodiment will be explained. Explanations of similar matters will be omitted.

Figure 11:
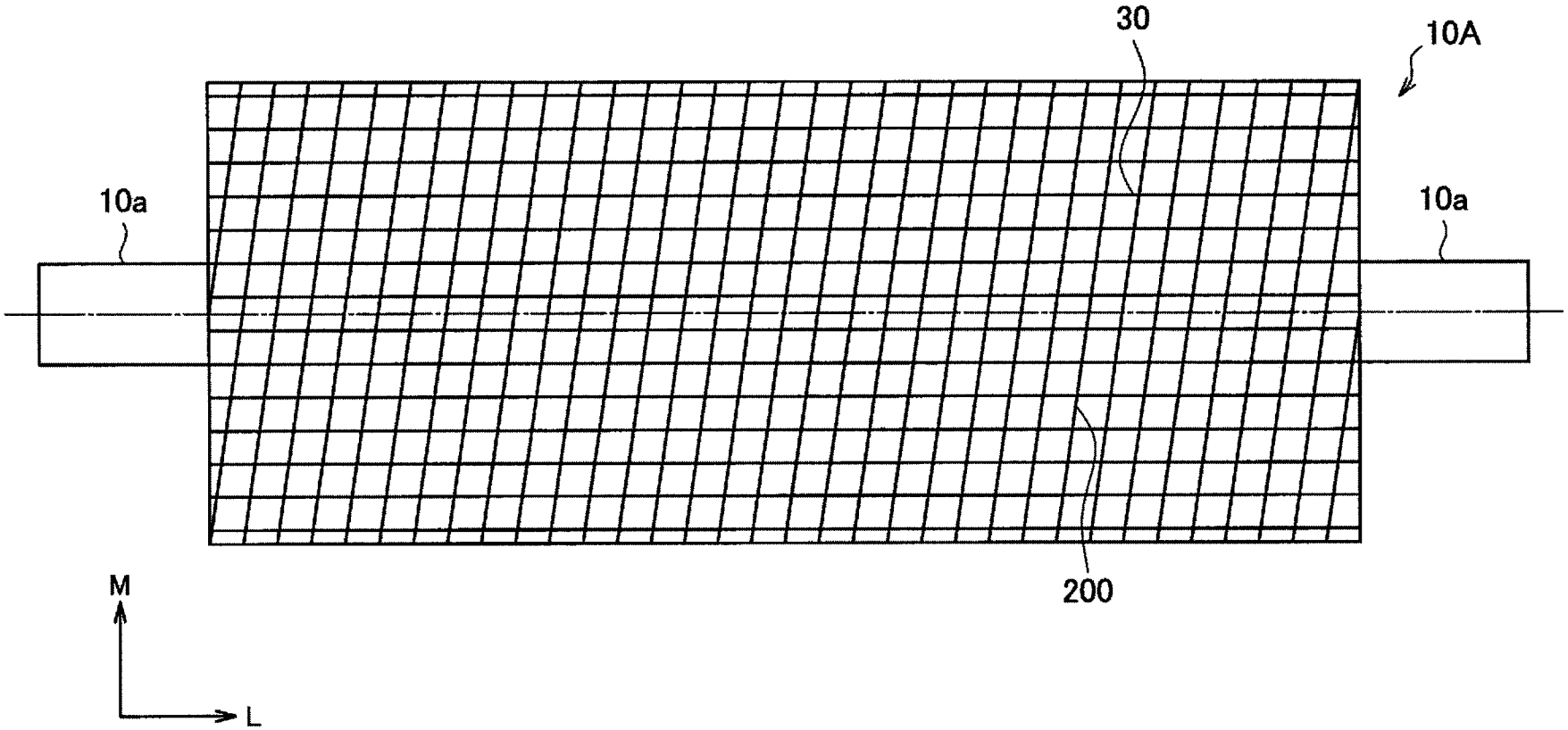
FIG. 11 is a side view showing one example of a bath roll according to a third embodiment of the present invention.

FIG. 11 is a side view showing one example of the bath roll 10A according to the third embodiment of the present invention. As shown in FIG. 11, the vertical grooves 200 are formed by a spiral shape so as to be offset in the barrel length direction L by one or more pitches per turn of the bath roll 10A.

By forming the vertical grooves 200 by a spiral shape, it is possible to keep groove shapes from being transferred to the steel strip 2 contacting the bath roll 10A. Further, by forming the grooves by a spiral shape, the ends of the vertical groove 200 are open, so molten metal containing dross becomes easily discharged to the outside not only from the horizontal grooves 30 but also the ends of the vertical grooves 200. That is, the effect of discharge of dross is improved.

Fourth Embodiment

Next, a bath roll 10B according to a fourth embodiment of the present invention will be explained. In the present embodiment, the horizontal grooves 300 of the bath roll 10B differ from the horizontal grooves 30 of the above first embodiment and are formed to have inclinations with respect to the barrel length direction of the bath roll 10B. Below, the points of difference of the present embodiment from the first embodiment will be explained. Explanations of similar matters will be omitted.

Figure 12:
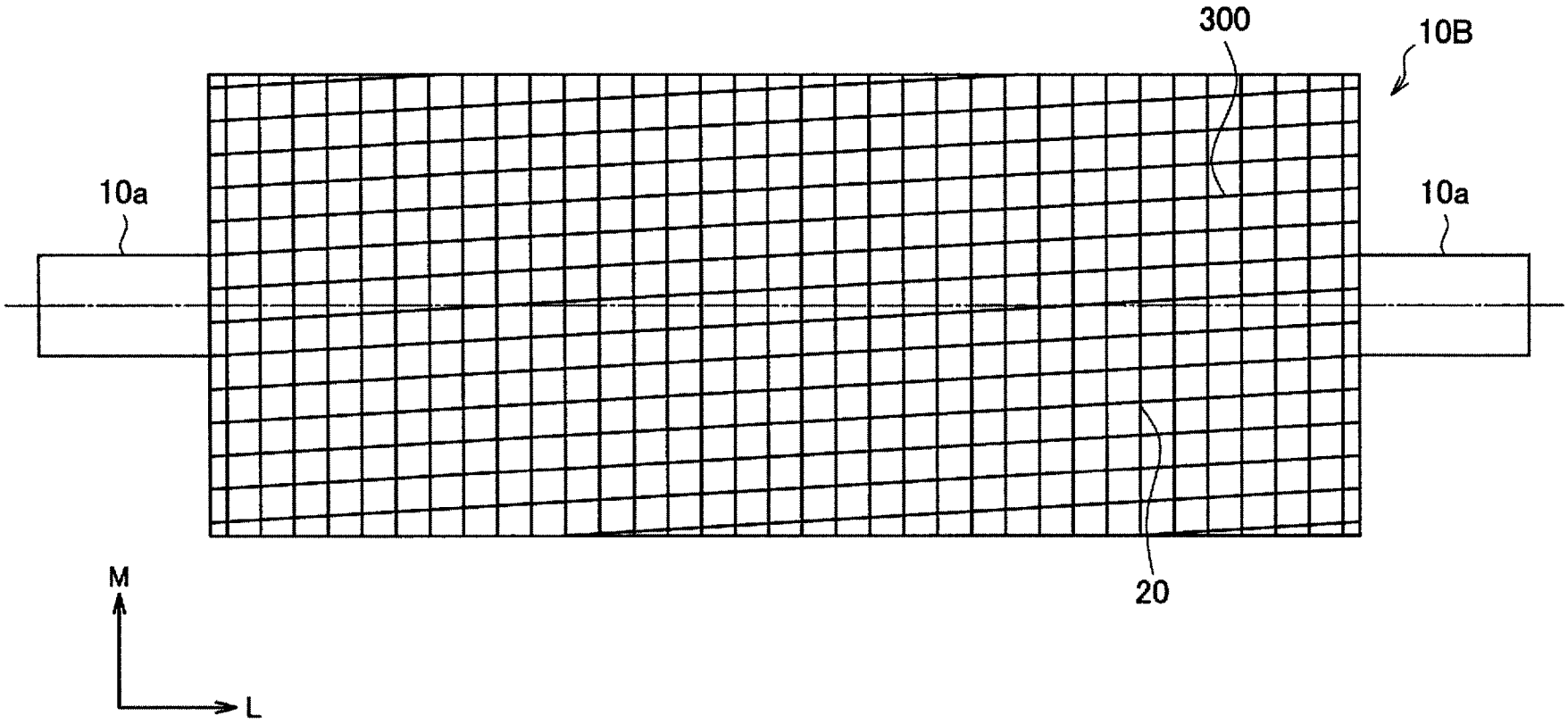
FIG. 12 is a side view showing one example of a bath roll according to a fourth embodiment of the present invention.

FIG. 12 is a side view showing one example of the bath roll 10B according to the fourth embodiment of the present invention. As shown in FIG. 12, the horizontal grooves 300 are formed with inclination of within 30° with respect to the barrel length direction L of the bath roll 10B. By imparting this inclination, the inertial force due to rotation of the bath roll 10 acts on the insides of the horizontal grooves 300 and molten metal containing dross becomes easy to discharge from the horizontal grooves 300. That is, the effect of discharge of dross is improved.

Note that, the direction of inclination of the horizontal grooves 300 with respect to the barrel length direction L of the bath roll 10B is not particularly limited. That is, the allowable range of the angle of inclination is within ±30°. If the angle of inclination is more than 30°, the once discharged dross is again easily caught between the steel strip 2 and bath roll 10B, so the effect of discharge of dross can no longer be sufficiently obtained.

Above, the bath rolls 10A and 10B according to the third and the fourth embodiments of the present invention were explained. Note that, the cross-sectional shapes of the grooves and the directions of formation of the grooves according to the above first to fourth embodiments can be suitably combined. By combining these, it is possible to obtain a better effect of discharge of dross.

EXAMPLES

Below, examples of the present invention will be explained. Note that, the following examples are only illustrations provided for demonstrating the advantageous effects of the present invention. The present invention is not limited to the following examples.

A plurality of types of bath rolls were produced in accordance with the method of production of a bath roll explained above. The individual bath rolls were actually used in the hot dip metal plating apparatus for being tested for evaluation of the bath rolls. At the time of roll manufacture, various manufacturing conditions were changed to manufacture a plurality of types of rolls with different cross-sectional shapes and forms of the vertical grooves and the horizontal grooves. Note that, the running speeds of the steel strip were 130 mpm and 150 mpm and the roll diameter of the bath roll was 700 mm.

The various conditions and results of evaluation applied in the examples of the present invention are shown in the following Table 1 and Table 2. Note that, for the notations of the vertical grooves and the horizontal grooves, for convenience for promoting understanding, the notations described in the above-mentioned embodiments are assigned. Furthermore, in the tables, in the columns of "Formulas (1) to (3)", examples satisfying the above-mentioned formulas (1) to (3) were marked as "S", while ones not satisfying them were marked as "N", while in the columns of "Ratio", examples with d2/d1 satisfying the above-mentioned range were marked as "S", while ones not satisfying them were marked as "N".

TABLE 1

| | Test conditions | | | | | | | | |
|---|---|---|---|---|---|---|---|---|---|
| | Vertical grooves | | | | | | | | Horizontal grooves |
| | Shape/ form | Cross-sectional shape | Pitch P1 (mm) | Depth d1 (mm) | 1st radius of curvature (mm) | 2nd radius of curvature (mm) | Straight part length (mm) | Formulas (1) to (3) | Angle of inclination (°) |
| Ex. 1 | Ring | 1 | 1.0 | 0.2 | 0.1 | 0.15 | 0.10 | S | 0 |
| Ex. 2 | Ring | 1 | 2.0 | 0.4 | 0.3 | 0.30 | 0.15 | S | 0 |
| Ex. 3 | Ring | 1 | 3.0 | 0.5 | 0.4 | 0.40 | 0.20 | S | 0 |
| Ex. 4 | Ring | 1 | 4.0 | 0.6 | 0.5 | 0.50 | 0.10 | S | 0 |
| Ex. 5 | Ring | 2 | 1.5 | 0.3 | 0.2 | 0.50 | — | S | 0 |
| Ex. 6 | Ring | 3 | 2.0 | 0.4 | 0.3 | 1.15 | — | S | 0 |
| Ex. 7 | Ring | 4 | 2.5 | 0.5 | 0.4 | 1.00 | 0.10 | S | 0 |
| Ex. 8 | Ring | 1 | 3.0 | 0.6 | 0.5 | 0.60 | 0.20 | S | 0 |
| Ex. 9 | Ring | 2 | 5.0 | 2.0 | 1.0 | 1.20 | — | S | 10 |
| Ex. 10 | Ring | 3 | 7.0 | 3.0 | 1.0 | 2.54 | — | S | 20 |
| Ex. 11 | Ring | 4 | 10.0 | 5.0 | 1.0 | 3.00 | 0.30 | S | 30 |
| Ex. 12 | Spiral | 1 | 1.0 | 0.2 | 0.1 | 0.10 | 0.05 | S | 0 |
| Ex. 13 | Spiral | 2 | 1.5 | 0.3 | 0.2 | 0.20 | — | S | 0 |
| Ex. 14 | Spiral | 3 | 2.0 | 0.4 | 0.3 | 1.15 | — | S | 0 |
| Ex. 15 | Spiral | 4 | 2.5 | 0.5 | 0.4 | 0.40 | 0.10 | S | 0 |

TABLE 1-continued

| | Test conditions | | | | | | | | | |
|---|---|---|---|---|---|---|---|---|---|---|
| | Horizontal grooves | | | | | | | | | |
| | Cross-sectional shape | Pitch P2 (mm) | Depth d2 (mm) | Width w2 (mm) | d2/d1 (%) | Ratio | 3rd radius of curvature (mm) | 4th radius of curvature (mm) | Contact area ratio (%) | Eval. |
| Ex. 1 | V | 1.5 | 0.12 | 0.24 | 60 | S | — | — | 18 | D |
| Ex. 2 | V | 1.7 | 0.32 | 0.64 | 80 | S | — | — | 16 | A |
| Ex. 3 | V | 2.5 | 0.50 | 1.00 | 100 | S | — | — | 14 | B |
| Ex. 4 | V | 3 | 0.72 | 1.44 | 120 | S | — | — | 9 | B |
| Ex. 5 | V | 1.7 | 0.24 | 0.48 | 80 | S | — | — | 9 | A |
| Ex. 6 | V | 2.5 | 0.40 | 0.80 | 100 | S | — | — | 9 | A |
| Ex. 7 | Curved | 3 | 0.60 | 0.90 | 120 | S | 0.3 | 0.4 | 13 | B |
| Ex. 8 | V | 3.5 | 0.90 | 1.80 | 150 | S | — | — | 15 | C |
| Ex. 9 | Curved | 7 | 2.00 | 2.70 | 100 | S | 1 | 1.2 | 12 | B |
| Ex. 10 | V | 10 | 2.50 | 5.00 | 83 | S | — | — | 11 | B |
| Ex. 11 | Curved | 10 | 4.00 | 3.00 | 80 | S | 1.2 | 1 | 12 | B |
| Ex. 12 | V | 1.5 | 0.12 | 0.24 | 60 | S | — | — | 13 | C |
| Ex. 13 | Curved | 1.7 | 0.24 | 0.80 | 80 | S | 0.2 | 0.3 | 9 | A |
| Ex. 14 | V | 2.5 | 0.40 | 0.80 | 100 | S | — | — | 9 | A |
| Ex. 15 | Curved | 3 | 0.60 | 1.00 | 120 | S | 0.5 | 0.4 | 13 | B |

TABLE 2

| | Test conditions | | | | | | | | |
|---|---|---|---|---|---|---|---|---|---|
| | Vertical grooves | | | | | | | | Horizontal grooves |
| | Shape/form | Cross-sectional shape | Pitch P1 (mm) | Depth d1 (mm) | 1st radius of curvature (mm) | 2nd radius of curvature (mm) | Straight part length (mm) | Formulas (1) to (3) | Angle of inclination (°) |
| Ex. 16 | Spiral | 1 | 3.0 | 0.6 | 0.5 | 0.50 | 0.15 | S | 0 |
| Ex. 17 | Spiral | 2 | 5.0 | 2.0 | 1.0 | 0.80 | — | S | 10 |
| Ex. 18 | Spiral | 3 | 7.0 | 3.0 | 1.0 | 2.54 | — | S | 20 |
| Ex. 19 | Spiral | 4 | 10.0 | 5.0 | 1.0 | 3.00 | 0.50 | S | 30 |
| Ex. 20 | Ring | 1 | 1.0 | 0.2 | 0.1 | 0.15 | 0.30 | S | 0 |
| Co. Ex. 1 | Ring | 1 | 1.0 | 0.2 | 0.1 | 0.15 | 0.10 | S | 0 |
| Co. Ex. 2 | Ring | 4 | 15.0 | 5.0 | 1.0 | 3.00 | 0.10 | N | 30 |
| Co. Ex. 3 | Ring | 1 | 2.0 | 1.5 | 0.1 | 0.10 | 0.10 | N | 0 |
| Co. Ex. 4 | Ring | 4 | 10.0 | 7.0 | 1.0 | 3.00 | 0.10 | N | 30 |
| Co. Ex. 5 | Spiral | 2 | 1.5 | 0.3 | 0.2 | 0.50 | — | S | 0 |
| Co. Ex. 6 | Spiral | 1 | 0.8 | 0.2 | 0.1 | 0.15 | 0.10 | N | 0 |
| Co. Ex. 7 | Spiral | 1 | 1.0 | 0.1 | 0.1 | 0.15 | 0.10 | N | 0 |

| | Test conditions | | | | | | | | | |
|---|---|---|---|---|---|---|---|---|---|---|
| | Horizontal grooves | | | | | | | | | |
| | Cross-sectional shape | Pitch P2 (mm) | Depth d2 (mm) | Width w2 (mm) | d2/d1 (%) | Ratio | 3rd radius of curvature (mm) | 4th radius of curvature (mm) | Contact area ratio (%) | Eval. |
| Ex. 16 | V | 3.5 | 0.90 | 1.80 | 150 | S | — | — | 13 | C |
| Ex. 17 | V | 7 | 2.00 | 4.00 | 100 | S | — | — | 12 | A |
| Ex. 18 | V | 10 | 2.50 | 5.00 | 83 | S | — | — | 11 | A |
| Ex. 19 | V | 10 | 3.00 | 7.00 | 60 | S | — | — | 14 | A |
| Ex. 20 | V | 1.5 | 0.12 | 0.24 | 60 | S | — | — | 30 | C |
| Co. Ex. 1 | V | 1.5 | 0.35 | 0.70 | 175 | N | — | — | 17 | E |
| Co. Ex. 2 | Curved | 12 | 4.00 | 3.00 | 80 | S | 1.2 | 1 | 7 | E |
| Co. Ex. 3 | V | 2.5 | 1.50 | 2.20 | 100 | S | — | — | 9 | E |
| Co. Ex. 4 | Curved | 12 | 5.00 | 3.00 | 71 | S | 1.2 | 1 | 10 | E |
| Co. Ex. 5 | V | 1.7 | 0.10 | 0.20 | 33 | N | — | — | 10 | E |
| Co. Ex. 6 | V | 1.5 | 0.12 | 0.24 | 60 | S | — | — | 23 | E |
| Co. Ex. 7 | V | 1.5 | 0.10 | 0.20 | 100 | S | — | — | 16 | E |

Note that, the No. 1 to No. 4 cross-sectional shapes of the vertical grooves are as follows:

No. 1: Corresponding to cross-sectional shape shown in FIG. 4 (first embodiment)

No. 2: Corresponding to cross-sectional shape shown in FIG. 7 (first modification)

No. 3: Corresponding to cross-sectional shape shown in FIG. 8 (second modification)

No. 4: Corresponding to cross-sectional shape shown in FIG. 9 (third modification)

The first curved part and the second curved part forming the cross-sectional shape of the vertical grooves of No. 1 to No. 4 are arc shapes which have the first radius of curvature and the second radius of curvature shown in Table 1.

Further, when the vertical grooves are formed by a spiral, the vertical grooves are formed offset in the barrel length direction by 1 or more pitches per turn of the bath roll.

Further, in the cross-sectional shape of the horizontal grooves, "V" shows the cross-sectional shape shown in FIG. 5, while "Curved" shows the cross-sectional shape according to the second embodiment shown in FIG. 10. Further, when the cross-sectional shape of the horizontal grooves is "Curved", the third curved part and fourth curved part forming the cross-sectional shape of the horizontal groove are arc shapes and respectively have the third radius of curvature and fourth radius of curvature.

Next, the results of evaluation of the examples and comparative examples will be explained while referring to Table 1 and Table 2. Note that, the symbols in the columns of "Evaluation" of Table 1 show the following results of evaluation.

A: No slip occurring and no dross flaws observed at 150 mpm or more

B: No slip occurring and slight dross flaws observed at 150 mpm or more

C: No slip occurring and no dross flaws observed at 130 mpm to less than 150 mpm D: No slip occurring and slight dross flaws observed at 130 mpm to less than 150 mpm E: Slip occurring a lower speed than 130 mpm As shown in Table 1 and Table 2, in the bath rolls of Examples 1 to 20, the pitch $P_1$ and depth $d_1$ of the vertical grooves satisfy the above-mentioned formulas (1) to (3), the ratio of the depth $d_2$ of the horizontal grooves to the depth $d_1$ of the vertical groove is 60% to 150% in range, and the width $w_2$ of the horizontal grooves is in the above-mentioned predetermined range. As a result, if the running speed is 130 mpm or more, no occurrence of slip could be seen.

Further, in the bath rolls according to Examples 2 to 7, 9 to 11, 13 to 15, and 17 to 19, furthermore, the ratio of the depth $d_2$ of the horizontal grooves to the depth $d_1$ of the vertical grooves is 80% to 120% in range. As a result, even if the running speed is 150 mpm or more, no occurrence of slip could be observed.

On the other hand, in the bath rolls of Comparative Examples 1 to 7, the pitch $P_1$ and depth $d_1$ of the vertical grooves failed to satisfy the above-mentioned formulas (1) to (3) or the ratio of the depth $d_2$ of the horizontal grooves to the depth $d_1$ of the vertical grooves was off from 60% to 150% in range. As a result, even if the running speed is a speed lower than 130 mpm, occurrence of slip was seen.

From the above, it was shown that by the pitch $P_1$ and depth $d_1$ of the vertical grooves satisfying the above-mentioned formulas (1) to (3), the ratio of the depth $d_2$ of the horizontal grooves with respect to the depth $d_1$ of the vertical grooves being 60% to 150% in range, and the bath roll being formed with the vertical grooves and horizontal grooves having predetermined ranges of widths of horizontal grooves, it is possible to run the steel strip without causing slip at a running speed of 130 mpm or more. Further, it was shown that if the ratio of the depths is within 80% to 120%, even at high speed running of 150 mpm or more, the deposition and buildup of dross in the grooves of the bath roll surface are suppressed and the steel strip can be stably run without causing slip.

Above, suitable embodiments of the present invention were explained in detail while referring to the attached drawings, but the present invention is not limited to these examples. A person having ordinary knowledge in the field of art to which the present invention belongs clearly could conceive of various changes or corrections in the scope of the technical idea described in the claims. It will be understood that these also naturally fall under the technical scope of the present invention.

REFERENCE SIGNS LIST

1 hot dip metal plating apparatus
2 steel strip (metal strip)
3 plating bath
4 plating tank
5 snout
6 support roll
7 gas wiping device
10, 10A bath roll
10*a* roll shaft
20 vertical groove
21 first curved part
22 second curved part
23 first flat part
24 second flat part
30 horizontal groove
31 side part
32 bottom part
20A vertical groove
41 first curved part
42 second curved part
43 side part
20B vertical groove
51 first curved part
52 second curved part
20C vertical groove
61 first curved part
62 second curved part
63 first flat part
30A horizontal groove
71 third curved part
72 fourth curved part
73 third flat part
74 fourth flat part
100 circumferential surface
110 groove region
120 contact region
200 vertical groove
300 horizontal groove

The invention claimed is:

1. A hot dip metal plating bath roll, which hot dip metal plating bath roll having vertical grooves each formed on an outer circumferential surface of the roll along a circumferential direction of said roll and including two first curved parts projecting to the outside of said roll and one or two second curved part arranged between said two first curved parts, projecting to the inside of said roll and configuring a recessed part by continuing from said two first curved parts respectively and horizontal grooves each formed on an outer circumferential surface of said roll along a barrel length direction of said roll, a pitch $P_1$ (mm) and depth $d_1$ (mm) of said vertical grooves satisfying the following formulas (101) to (103):

$$1.0 \leq P_1 \leq 10 \quad (101)$$

$$0.2 \leq d_1 \leq 5 \quad (102)$$

$$d_1 P_1/2 \quad (103),$$

a depth $d_2$ (mm) of said horizontal grooves being 60% to 150% of the depth $d_1$ of said vertical grooves, and a width $w_2$ (mm) of said horizontal grooves being 2 times or more of the depth $d_2$ or 2 times or more of a radius of curvature (mm) of curved surfaces forming bottom parts of said horizontal grooves and 0.7 times or less of a pitch $P_2$ (mm) of said horizontal grooves, the pitch $P_2$ (mm) of said horizontal grooves being $1.0 \leq P_2 \leq 10$.

2. The hot dip metal plating bath roll according to claim 1, which is used in contact with the steel strip in a molten metal plating bath, wherein an area of regions at an outer circumferential surface of said roll able to contact said steel strip is 1.0% to 20% of the area of the circumferential surface of said roll provided with the grooves.

3. The hot dip metal plating bath roll according to claim 1, wherein the depth d2 of said horizontal grooves is 80% to 120% of the depth di of said vertical grooves.

4. The hot dip metal plating bath roll according to claim 1, wherein a cross-sectional shape of said horizontal grooves is a V-shape.

5. The hot dip metal plating bath roll according to claim 1, wherein each said horizontal groove includes two third curved parts projecting toward the outside of said roll and one or two fourth curved part arranged between said two third curved parts, projecting toward the inside of said roll and configuring a recessed part by continuing from said two third curved parts respectively.

6. The hot dip metal plating bath roll according to claim 1, wherein at the outer circumferential surface of said roll, an angle formed by a plane surface of a top part formed between said horizontal grooves and plane surfaces of side parts of said horizontal grooves is 65° or less.

7. The hot dip metal plating bath roll according to claim 5, wherein at the outer circumferential surface of said roll, an angle formed by a plane surface of a top part formed between said horizontal grooves and plane surfaces of side parts of said horizontal grooves is defined by arc tangent of $d_2/(r3+r4)$ and is 65° or less when radius of curvature of said third curved part is r3, radius of curvature of said fourth curved part is r4 and depth of said horizontal grooves is $d_2$.

8. The hot dip metal plating bath roll according to claim 1, wherein said vertical grooves are comprised of spiral groove formed in a spiral shape along a circumferential direction of said roll.

9. The hot dip metal plating bath roll according to claim 1, wherein said vertical grooves are comprised of ring-shaped grooves formed in straight line shapes along a circumferential direction of said roll.

10. A method of production of a hot dip metal plating bath roll, said method of production of a hot dip metal plating bath roll comprising:

a vertical groove forming step of forming, along the circumferential direction of the roll, vertical grooves each including two first curved parts projecting to the outside of said roll and one or two second curved part arranged between said two first curved parts, projecting to the inside of said roll and configuring a recessed part by continuing from said two first curved parts respectively by lathing on an outer circumferential surface of the roll and a horizontal groove forming step of forming, on said outer circumferential surface of the roll, horizontal grooves along a barrel length direction of said roll, a pitch $P_1$ (mm) and depth $d_1$ (mm) of the vertical grooves satisfying the following formulas (101) to (103):

$$1.0 \leq P_1 \leq 10 \quad (101)$$

$$0.2 \leq d_1 \leq 5 \quad (102)$$

$$d_1 P_1/2 \quad (103),$$

a depth $d_2$ (mm) of said horizontal grooves being 60% to 150% of the depth $d_1$ of said vertical grooves, and a width $w_2$ (mm) of said horizontal grooves being 2 times or more of the depth $d_2$ or 2 times or more of a radius of curvature R2 (mm) of curved surfaces forming bottom parts of said horizontal grooves and 0.7 times or less of a pitch $P_2$ (mm) of said horizontal grooves, the pitch $P_2$ (mm) of said horizontal grooves being $1.0 \leq P_2 \leq 10$.

* * * * *